United States Patent [19]

Smith

[11] 4,378,207

[45] Mar. 29, 1983

[54] INFRA-RED TREATMENT

[76] Inventor: Thomas M. Smith, 114 Villinger Ave., Cinnaminson, N.J. 08077

[21] Appl. No.: 186,491

[22] Filed: Sep. 12, 1980

Related U.S. Application Data

[63] Continuation-in-part of Ser. No. 94,901, Nov. 16, 1979, Pat. No. 4,272,238, Ser. No. 20,079, Mar. 13, 1979, Pat. No. 4,290,746, Ser. No. 952,332, Oct. 18, 1979, Pat. No. 4,326,483, Ser. No. 863,251, Dec. 22, 1977, Pat. No. 4,224,018, and Ser. No. 775,838, Mar. 9, 1977, Pat. No. 4,272,237, said Ser. No. 94,901, Ser. No. 20,079, and Ser. No. 952,232, each is a continuation-in-part of Ser. No. 906,229, May 15, 1978, Pat. No. 4,157,155, Ser. No. 863,251, , and Ser. No. 775,838, , said Ser. No. 906,229, Ser. No. 863,251, and Ser. No. 775,838, each is a continuation-in-part of Ser. No. 701,687, Jul. 1, 1976, abandoned, which is a continuation-in-part of Ser. No. 674,409, Apr. 7, 1976, Pat. No. 4,035,132, said Ser. No. 775,838, is a continuation-in-part of Ser. No. 674,409.

[51] Int. Cl.[3] ..... F27B 9/28; F26B 13/00; C21D 9/54; F23D 13/12

[52] U.S. Cl. ..... 432/8; 266/103; 431/328; 432/31; 432/59; 432/226

[58] Field of Search ..... 432/8, 31, 59, 226; 266/102, 103; 431/328

[56] References Cited

U.S. PATENT DOCUMENTS

| | | | |
|---|---|---|---|
| 2,427,892 | 9/1947 | Adams | 431/328 |
| 2,869,846 | 1/1959 | Bloom | 266/103 |
| 3,008,513 | 11/1961 | Holden | 431/328 |
| 3,020,032 | 2/1962 | Casey | 432/8 |
| 3,359,965 | 12/1967 | Milligan | 431/328 |
| 3,421,746 | 1/1969 | McCoy | 432/8 |
| 3,675,905 | 7/1972 | Placek | 432/226 |
| 3,909,196 | 9/1975 | Birke et al. | 8/140 |
| 4,207,058 | 6/1980 | Petersohn et al. | 432/59 |
| 4,255,123 | 3/1981 | Bishilany et al. | 431/328 |
| 4,272,238 | 6/1981 | Smith | 431/328 |

FOREIGN PATENT DOCUMENTS

| | | | |
|---|---|---|---|
| 466658 | 6/1937 | United Kingdom . | |
| 522654 | 6/1940 | United Kingdom | 432/59 |

*Primary Examiner*—John J. Camby
*Attorney, Agent, or Firm*—Connolly and Hutz

[57] ABSTRACT

Infra-red heating of moving webs using re-radiator surfaces adjacent to or opposed to infra-red generating surface. Scoop can be provided to remove boundary gas layer on web before it is irradiated, and hot combustion products drawn off and applied to web to assist in heat treatment. These hot combustion products can also be permitted to build up in depth below a downwardly facing infra-red generator.

20 Claims, 23 Drawing Figures

INFRA-RED TREATMENT

This application is a continuation-in-part of applications Ser. No. 94,901 filed Nov. 16, 1979 (U.S. Pat. No. 4,272,238 granted June 9, 1981), Ser. No. 20,079 filed Mar. 13, 1979 (U.S. Pat. No. 4,290,746 granted Sept. 22, 1981), Ser. No. 952,332 filed Oct. 18, 1979, (U.S. Pat. No. 4,326,843 granted Apr. 27, 1982), Ser. No. 863,251 filed Dec. 22, 1977 (U.S. Pat. No. 4,224,018 granted Sept. 23, 1980) and Ser. No. 775,838 filed Mar. 9, 1977 (U.S. Pat. No. 4,272,237 granted June 9, 1981). In turn, Ser. No. 94,901, Ser. No. 20,079 and Ser. No. 952,332 are continuations-in-part of each of the other patent applications as well as of application Ser. No. 906,229 filed May 15, 1978 (U.S. Pat. No. 4,157,155 granted June 5, 1979); applications Ser. No. 906,229, Ser. No. 863,251 and Ser. No. 775,838 are each continuations-in-part of application Ser. No. 701,687 filed July 1, 1976 and subsequently abandoned; and Ser. No. 775,838 and Ser. No. 701,687 are each continuations-in-part of application Ser. No. 674,409 filed Apr. 7, 1976 (U.S. Pat. No. 4,035,132 granted July 12, 1977).

The present invention relates to the infra-red irradiation of substrates such as webs of textile, paper, or the like.

Among the objects of the present invention is the provision of techniques and equipment for effecting infra-red irradiation with improved results.

The foregoing as well as still further objects of the present invention are set out in the following description of several of its exemplifications, reference being made to the accompanying drawings wherein.

The heating of webs of paper, textile or the like, to dry them for example, is an awkward commercial operation, particularly where the webs to be heated are moving at the usual production speeds which can range up to several thousand feet per minute. Over the years the art had adopted the use of long hot air ovens, or tenter frames or a series of steam-heated rolls over which the web is carried and against which it is heated by contact.

In the drying of paper manufactured on a Fourdrinier type machine, a single paper production line drier can have scores of steam rolls, each supplied with steam generated an appreciable distance from the rolls. Each steam roll is a very expensive investment and the generation and transportation of the steam involves substantial thermal inefficiencies, even when the steam is generated with a low-cost fuel.

The use of infra-red irradiation to help dry moving webs has been tried in limited ways and has been found desirable, particularly with respect to thermal efficiency. Infra-red radiation has also been suggested for controlling the drying profile across the width of a web, as in U.S. Pat. Nos. 3,040,807, 3,293,770, 3,793,741 and 4,188,731 as well as in the Paper Trade Journal issue of June 10, 1963, pp. 40–43.

The present invention supplies infra-red radiation techniques with particularly high thermal efficiency and low capital cost, for drying or heating webs.

Figure 1:
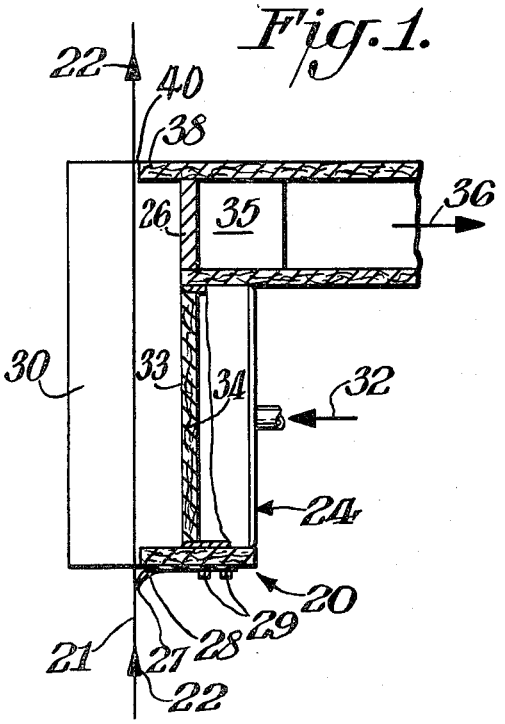
FIG. 1 is a vertical sectional view, partly broken away, of the key features of an arrangement for infra-red irradiation of a moving paper web pursuant to the present invention.

Turning now to FIG. 1, there is here shown a drying station 20 for a wet paper web 21. The web is moving upwardly, in the direction of the arrows 22, past the drying station. The station includes an infra-red generating gas burner 24, a re-radiator 26 of infra-red energy, a scoop means 28, and side walls 30.

Scoop means 28 is a metal or plastic plate extending the width of web 21 and shown secured at one end to a body of the burner by bolts 29. The scoop is so arranged that its other end 27 is bent with a gradual curvature to point toward the direction from which the web is approaching and to come within about 1 millimeter of the paper surface. No spacing is actually needed between the scoop end 27 and the paper surface, and the less the spacing the better. The scoop end can even touch the paper, but care should then be taken that the scoop is not worn away too rapidly by such frictional engagement.

After the web passes the scoop, it is exposed to the direct radiation of generator 24. This generator can be constructed as described in FIG. 18 or FIG. 16 of parent application Ser. No. 94,901 or FIG. 18 of parent application Ser. No. 952,332, the entire contents of which applications are included in the present application as though fully set forth herein. Gaseous combustion mixture is fed to the burner and is represented by the arrow 32. This mixture burns at the outer face 33 of a fibrous ceramic matrix 34 and that face is heated by the combustion to a temperature of from about 1100° to about 1600° F., depending upon the rate at which combustion mixture is supplied.

At the combustion temperatures infra-red radiation is emitted in all directions from the heated surface 33, and subjects the web 21 to very intense thermal energy. Indeed an incandescent surface 33 that extends only about 11 inches along the path through which a wet paper web moves, provides as much or more drying as four or five steam-heated five-foot-diameter drying rolls.

Matrix 34 preferably is a felted ceramic fiber mat as described in the parent applications. Particularly desirable are such mats that are stiffened by starch and finely divided clay. Although starch decomposes at temperatures much lower than 1100° F., such decomposition does not extend deeply into the matrix, and forms a carbonaceous layer that may help keep the infra-red radiation from backward penetration any deeper into the matrix. The flow of combustion mixture in the forward direction through the matrix keeps the matrix below the starch-decomposing temperature at distances as small as about 1 to 2 millimeters from the incandescence.

After passing the burner 24, the paper web 21 passes in front of a re-radiator panel 26 which can be a porous ceramic fiber mat just like matrix 34 or a felted or needled more flexible blanket of ceramic fibers. The hot gaseous combustion products of burner 24 rise, flow over the face of panel 26, and move through the pores of the panel into a discharge plenum 35 from which they then are discharged as shown by arrow 36. To help with such movement a blower can be inserted in the discharge conduit to suck the gaseous combustion products through panel 26. This suction need be no greater than that which assures the flow of all the hot combustion products through panel 26 with no substantial dilution as by ambient air drawn in from around the heating station. To minimize such dilution, the station includes a barrier 38 that reaches close to the adjacent surface of web 21 and side walls 30 extend past the side edges of the web. Barrier 38, walls 30, the discharge plenum and the associated structure can all be fibrous or non-fibrous ceramic mats. Power exhausting through panel 26 provides better control and substantially improves the heat exchange efficiency by minimizing the boundary layer effect present when the hot gaseous combustion products merely flow past the face of the panel.

The continuous contacting of the outer face of panel 26 with these hot gases causes that face to heat up to temperatures close to the temperature of those gases, generally only a few hundred degrees F. below the temperature of matrix face 33. The outer face of panel 26 accordingly becomes an effective re-rediator of infra-red energy and thus adds to the thermal efficiency of the station. In general, unless the re-radiating surface area is at least about one-fourth the surface area of incandescent face 33, the added efficiency might not be worth the extra construction, although even a one-inch height of panel 27 provides a measurable increase in the heating effect.

The gaseous combustion products withdrawn at 36 can be led to a different station where they can be used, as a space heater for example, or to help heat a pulp digester or the like. These combustion products have a unusually low content of carbon monoxide and nitrogen oxides, so that they are not significant health hazards. If desired these combustion products can be diluted with ambient air sucked in through the walls of discharge plenum 35 or the walls of the discharge conduit, downstream of panel 26, so as to avoid cooling that panel. Thus the ceramic walls of that plenum or conduit can be made porous in those locations.

If the web being irradiated contains a resin or other material which on drying gives off decomposition products or other contaminants, the draw-off suction applied to discharge plenum 35 can be limited so as to keep from drawing off all the gaseous material between web 21 and the front of panel 26. The gases not sucked away are then carried off by the moving web and vented through the gap 40 between barrier 38 and the web. These vented gases can be exhausted through a separate exhaust system, if desired, and used where any contaminant content will not be harmful.

Minimizing the contaminant content in the gases sucked through panel 26, minimizes the danger of having the pores in that panel plugged by contaminants, and also provides a draw-off stream of hot relatively pure combustion products that can be used to heat other materials without significantly contaminating them.

By way of example, only about 60 to 80% of the hot gases between web 21 and panel 26 can be sucked through that panel.

A feature of the FIG. 1 apparatus, is that if, as sometimes happens, there is a tear in the paper web 32 and the torn leading edge curls toward the burner side of the paper, that curl will be engaged and deflected by the scoop 28 so that it does not reach the incandescent face 33 and does not become ignited.

When paper is sufficiently dry, it will ignite if exposed too long to the incandescent face 33, even when that face is at the relatively low temperature of 1100° F. To prevent ignition from such over-exposure, the web-moving equipment is connected to shut off the combustion mixture feed to the burner or the feed of fuel gas to the combustion mixture, when the speed is reduced below one foot per second or thereabouts. Somewhat lower speeds can be tolerated at the wet end of a paper dryer.

Electric ignition is highly desirable for the burner 24, inasmuch as no pilot light is then necessary and the incandescent face 33 can be kept fairly close to the paper web. A four-inch or less spacing from the web makes a very desirable arrangement, and to this end the electric ignition of U.S. Pat. No. 4,157,155 is particularly suitable. However, a pilot flame can be used instead of electric ignition, even with a two-inch spacing between the web and face 33, if the pilot flame is of relatively short length and provided as in the construction of FIG. 22 of Ser. No. 94,901, using a gas-air mixture to produce a blast-like flame.

The entire heating unit 20 can be made retractible so that it can withdraw from close engagement with web 21, as for example to thread a torn leading edge of the web past the heating station and to permit lighting of the burner's pilot light where one is used.

Figure 2:
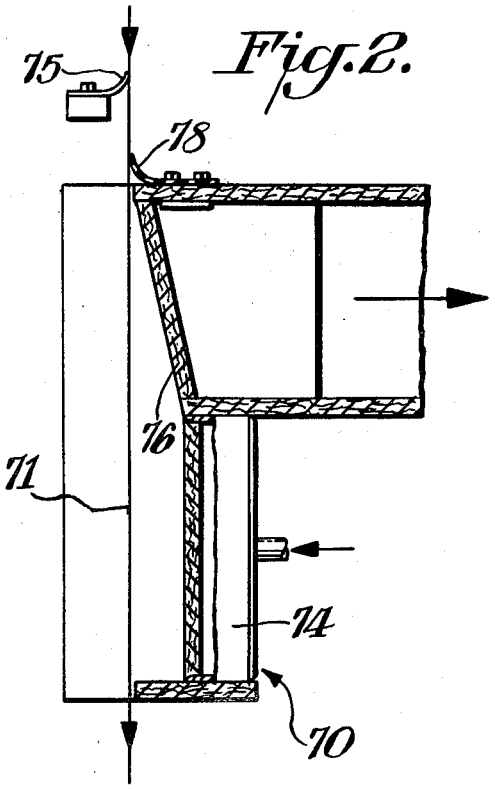
FIG. 2 is a view similar to that of FIG. 1 of a modified arrangement for such irradiation.

FIG. 2 shows a modified drying station 70 having two scoop plates 78 and 75 in close juxtaposition to a web 71 which in this case is moving downwardly. The burner 74 of this station can be the same as burner 24 of FIG. 1, but re-radiator plate 76 of FIG. 2 is inclined so that its upper end is very close to web 71, and it also has an outer face with about the same surface area as the incandescent burner face.

The inclination of plate 76 causes the hot gaseous combustion products to come into very close contact with the web as these gaseous products rise, and thus transfer some of their heat to the web by conduction.

This conduction heating is in addition to the re-radiation that is also produced at the outer face of panel 76.

Any or all of the scoops of FIGS. 1 and 2 can be replaced by a pair of pinch rollers that engage both faces of the paper web, or an idler roller that engages the face to be irradiated at the heating station. Rollers are not as desirable as scoops, but they will keep boundary layer moist air from remaining in contact with the sheet as it is being irradiated.

Burners 24 and 74 are illustrated as of the non-air-seal matrix type, but air-seal matrix burners as in FIG. 8 below, can be used in their place.

Other types of gas-fired infra-red generators can be used in place of burners 24 or 74, but the ceramic fiber matrix burner is superior not only because of its greater efficiency in generating infra-red energy, but also because shutting off the flow of combustion mixture causes an incandescent matrix surface to cool in about 5 seconds or less to the point that it will not feel hot when touched with a bare hand. Even quicker cool-downs can be arranged by merely shutting off the flow of fuel gas, but maintaining the flow of the air used for the combustion.

Figure 4:
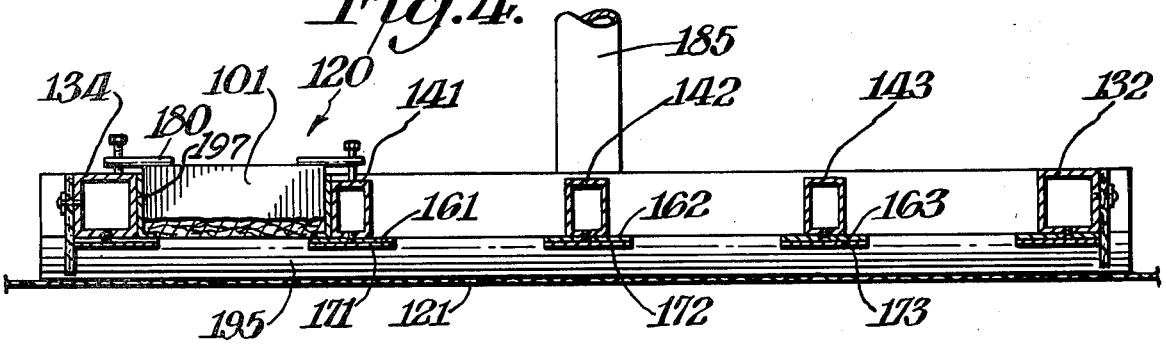
FIG. 4 is a sectional view taken along line 4—4, of the infra-red generating assembly of FIG. 3.
Figure 3:
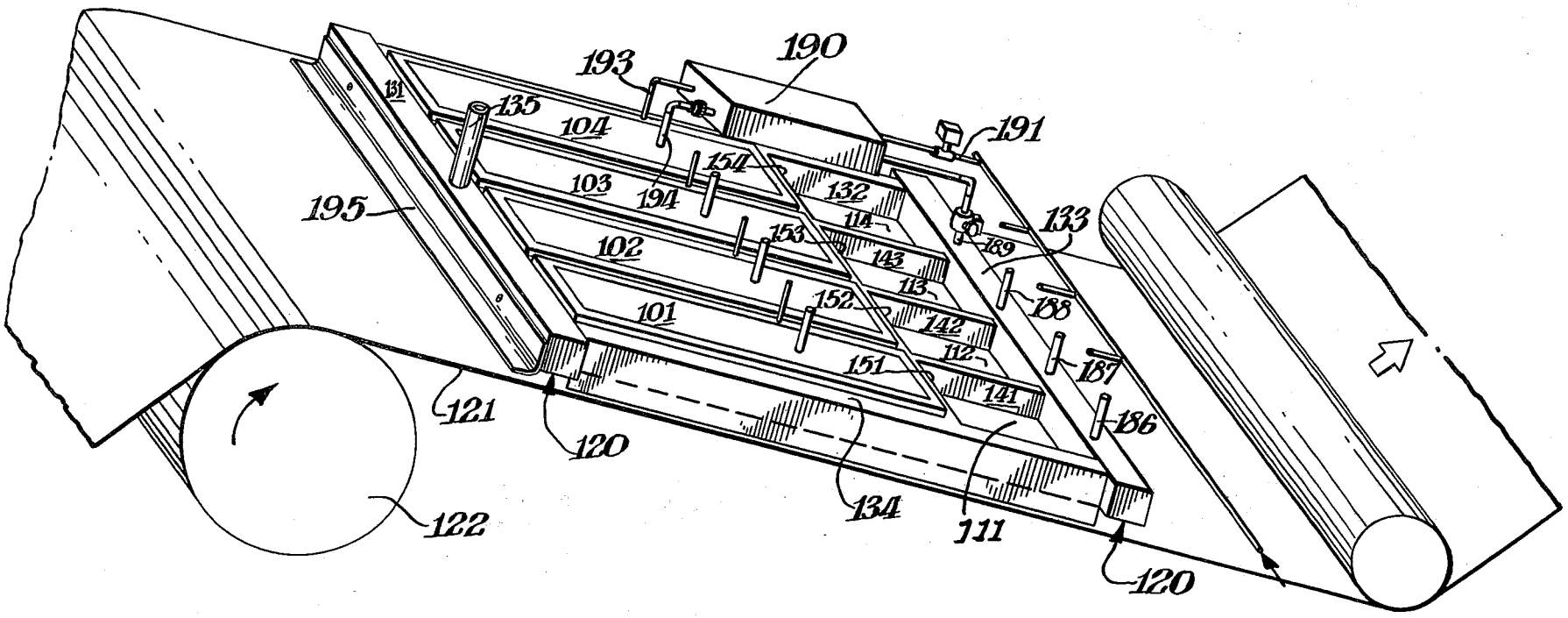
FIG. 3 is an isometric view, with portions broken away, of a profile drying arrangement for a wide paper web according to the present invention.

The drying arrangement of FIGS. 3 and 4 has a series of burners 101, 102, 103 and 104 spaced from each other to make a row that extends the width of a paper web 121 as it comes off the last roll 122 of a paper drier. Each burner covers only a small width of the web, and is backed up with its own re-radiator 111, 112, 113 and 114, respectively.

The burners are illustrated as of the air-seal type more fully shown and described in FIGS. 10 through 16 of Ser. No. 94,901. They are mounted in a frame 120 of welded-together hollow rectangular metal tubes 131, 132, 133, 134, having all their hollow interiors interconnected. The outer lengths of tubing 131, 132, 133 and 134 are shown as larger in cross-section than inner lengths 141, 142 and 143 that extend along the direction of web movement. Additional short lengths 151, 152, 153 and 154 of tubing or solid bars or sheets can be welded in transversely to brace the frame and provides added support for the re-radiators.

To the lower face of the internal tubing lengths there are secured thermal insulation plates 161, 162, 163 that extend transversely in both directions from those lengths, to cover the faces of burner margins. The burner bodies are shown as held by top fingers 180 a little above plates 161, 162, 163 to provide some clearance for escape of air-seal air through the space between a burner edge and the adjacent length of hollow tubing. A blanket 197 of porous material such as thermal insulation or metal wool can be fitted in the latter space.

Plates 161, 162 and 163 have their lower faces covered with additional thermal insulation strips 171, 172, 173 covering metallic fasteners that secure the plates to the frame. If desired the side edges of the strips 171, 172, 173 can be curved upwardly a little to help guide emerging air-seal air to the desired escape path, as in FIG. 10 hereinafter.

Frame length 131 is fitted with a pipe connection 185 through which air is blown into the interior of the hollow frame members. This air is delivered through outlets 186, 187, 188 and 189 provided in the opposing frame length 133, to the individual burners respectively. The main air supply is combustion air which goes through a separate mixer 190 and to a combustion mixture inlet 194 for each burner, and a valved fuel gas supply line 191 is also connected to each mixer. In addition each burner has a branched air line 193 provided for supplying air-seal air.

A scoop plate 195 can also be fastened to the leading face of frame member 131.

The arrangement of FIG. 3 is connected so that any or all of the burners can be turned on as desired, for the purpose of applying extra drying to the incremental paper widths irradiated by the burners. In this way the paper can be made to have a substantially uniform transverse moisture profile. Insulating strips 171, 172 and 173 act as re-radiators to broaden somewhat the irradiation field of each burner, but if desired a duplicate framework of burners can be provided adjacent the paper track and transversely offset enough from the first framework to bring the burners of the second framework over paper widths that fall between adjacent burners of the first framework. This provides a staggered collection of burners that more uniformly cover the incremental widths of the paper web.

The individual burners of FIG. 3 can have radiant faces that extend transversely of the web as little as six inches or as much as twelve inches, depending upon how many steps are desired in the transverse profile, for webs as much as 120 inches wide or wider. Standard moisture sensors can be arranged to detect the moisture content of the web in each transverse step, and to do this upstream and/or downstream of the apparatus of FIG. 3. The appropriate burners can then be operated either manually or automatically to irradiate the moistest steps, if desired with varying intensities. A radiant face extending about 24 to 48 inches in the direction of web travel is adequate to control the drying profile of webs moving as fast as several thousand feet per minute.

Whether the burners are lit with pilot flames or electric igniters, they take a few second before they begin to generate the desired infra-red energy at the set rate. Faster responses can be obtained by arranging for the burners to continually burn, and to control the drying profile by merely varying the intensity with which each burner burns and do this through regulation of the combustion mixture supply to the individual burners.

The framework of FIG. 3 can have the radiant burner faces in the horizontal plane for a paper web moving horizontally, in the vertical plane for a web moving vertically, or in any intermediate plane. In the illustrated orientation the plane is slightly tilted from the horizontal, with the re-radiators slightly lower than the radiant burner faces. This calls for the hot combustion gases emitted by these radiant faces to travel downwardly a little to reach the re-radiators 111, 112, 113 and 114 and this they do. These re-radiators can be omitted from the FiG. 3 combination, particularly when irradiating a web standing on edge, as for example moving horizontally with its transverse width extending vertically. When such re-radiators are used their transverse span should extend horizontally so as to permit hot combustion gases to uniformly reach all transverse portions of each re-radiator.

Sensing controls for activating the individual burners in the profile can be of the scanning type as shown for example in U.S. Pat. Nos. 3,040,807, 3,214,845, 3,731,586, 3,864,842, or of the non-scanning type as referred to in U.S. Pat. Nos. 3,358,378 and 3,793,741, and German Auslegeschrift No. 2,655,972. They can also be of the non-contacting or web-contacting types.

Figure 5:
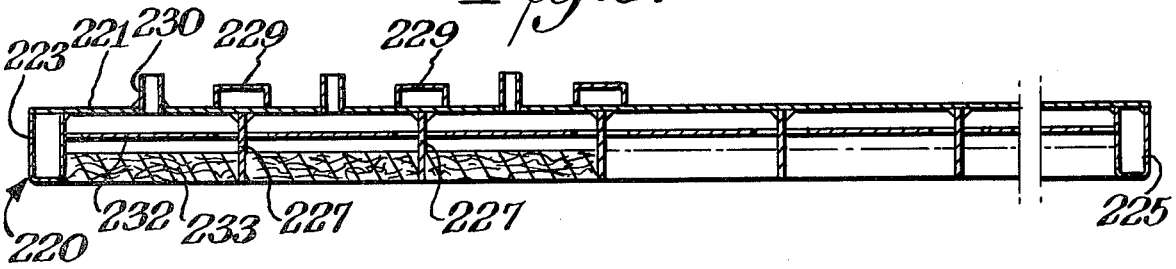
FIG. 5 is a sectional view similar to that of FIG. 4, showing a modified infra-red generating assembly for use in an arrangement of the type illustrated in FIG. 3.

The air-seal burners 101, 102, 103 and 104 can be replaced by non-air-seal burners such as those shown in FIGS. 1 and 2. When non-air-seal burners are used they can be packed closely together so that only one frame of burners will more uniformly span the width profile of the paper web. FIG. 5 shows such a construction.

In FIG. 5 a frame 220 is made of a plate 221 of a metal like aluminum, to one face of which are brazed end channels 223, 225, and an intervening series of spaced partitions 227. The opposite face of the plate can have additional channels 229 brazed in place over the respective partitions. End channels 223, 225 and intermediate channels 229 are oriented so that they form closed tubular passageways against plate 221.

Each of the downwardly facing troughs between partitions 227 and between an end channel and the adjacent partition, is built up into a matrix type burner of the non-air-seal kind. To this end each is provided with one or more combustion mixture inlets 230, a baffle 232 that can be tack-welded or cemented in place at its edges, and a matrix 233 cemented in place at its edges. The cement for the matrix should be a silicone resin or other material that withstands temperatures as high as 450° F. When the baffle 230 is cemented in place a heat-resistant cement is also used, but the temperature to which the baffle edges are subjected when the burners are in use is generally lower than 400° F.

As explained in parent applications Ser. No. 20,079 and 94,901, the use of burner walls 227 which very rapidly conduct heat away from the matrix edges keeps a thin layer of the matrix-securing cement sufficiently cool to prevent its decomposition except possibly for the outermost few thousandths of an inch where it comes in direct contact with incandescent fiber.

Making partitions 227 of aluminum plates only about ⅛ to ¼ inch thick and water-cooling the frame, accomplishes this objective and also keeps the frame from excessive mechanical distortion by reason of thermal expansion during burner operation. Water cooling is readily effected by passing water through end tubes 223, 225 as well as through intervening tubes 229. Also the frame can have its leading and trailing ends provided with cooling tubes as in FIG. 3. Any or all of the individual burners can then be operated for indefinite periods of time. Where the water cooling is sufficiently effective there is no need for baffles to bring the incoming combustion mixture into maximum heat-exchange contact with the inside surfaces of the burner walls, and they can then be replaced by simple baffles that merely deflect incoming combustion mixture laterally to keep it from concentrated impingement against localized portions of the matrix opposite the inlets 230. Alternatively the baffles can be completely eliminated, and if desired the combustion mixture inlets relocated so that they run horizontally and open into the small end walls of the burners.

The individual burners of FIG. 5 can be made as narrow as 5 inches or even less, to thus provide any narrow profile control steps.

The infra-red heating of the present invention can be applied as the first or the last heat treatment stage of a wet web, or at any intermediate point in the drying of the web. Because the gas-fired burners have an exceedingly high power density and can be made of almost diminutive size, they can be readily fitted into compact spaces and retrofitted in many prior art types of dryers.

Figure 6:
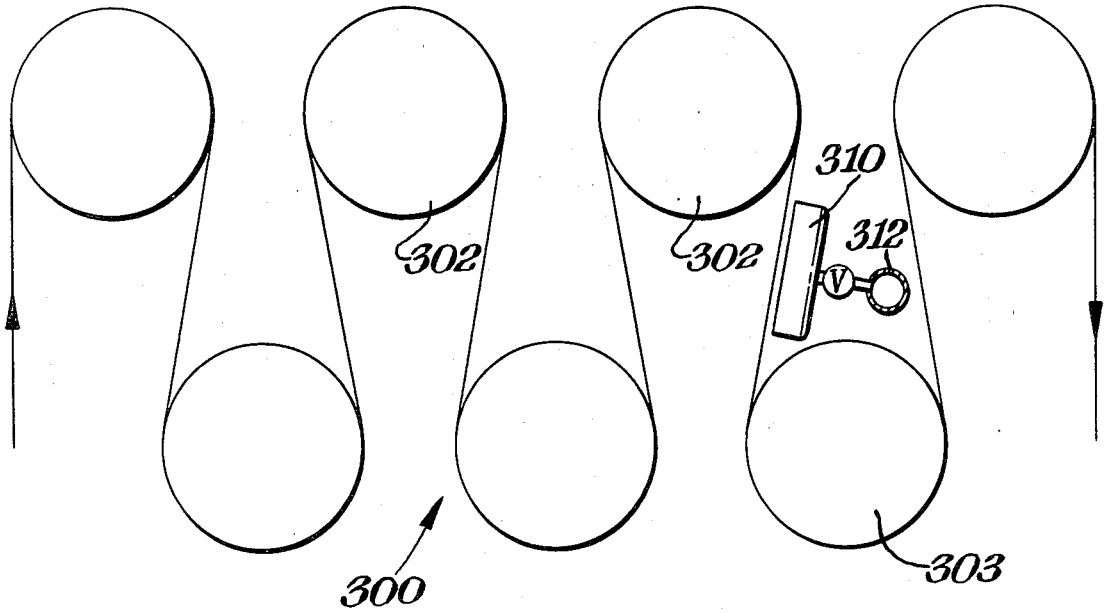
FIG. 6 is a schematic side view of a further modification of an infra-red irradiation treatment representative of the present invention.

FIG. 6 shows a portion of a steam-roll type of dryer generally indicated at 300 with an infra-red generator of the present invention 310 positioned between two steam rolls 302, 303. Generator 310 can have an overall height of only about 14 inches or even less, and an overall width including a combustion mixture manifold 312, of about the same dimension.

Figure 7:
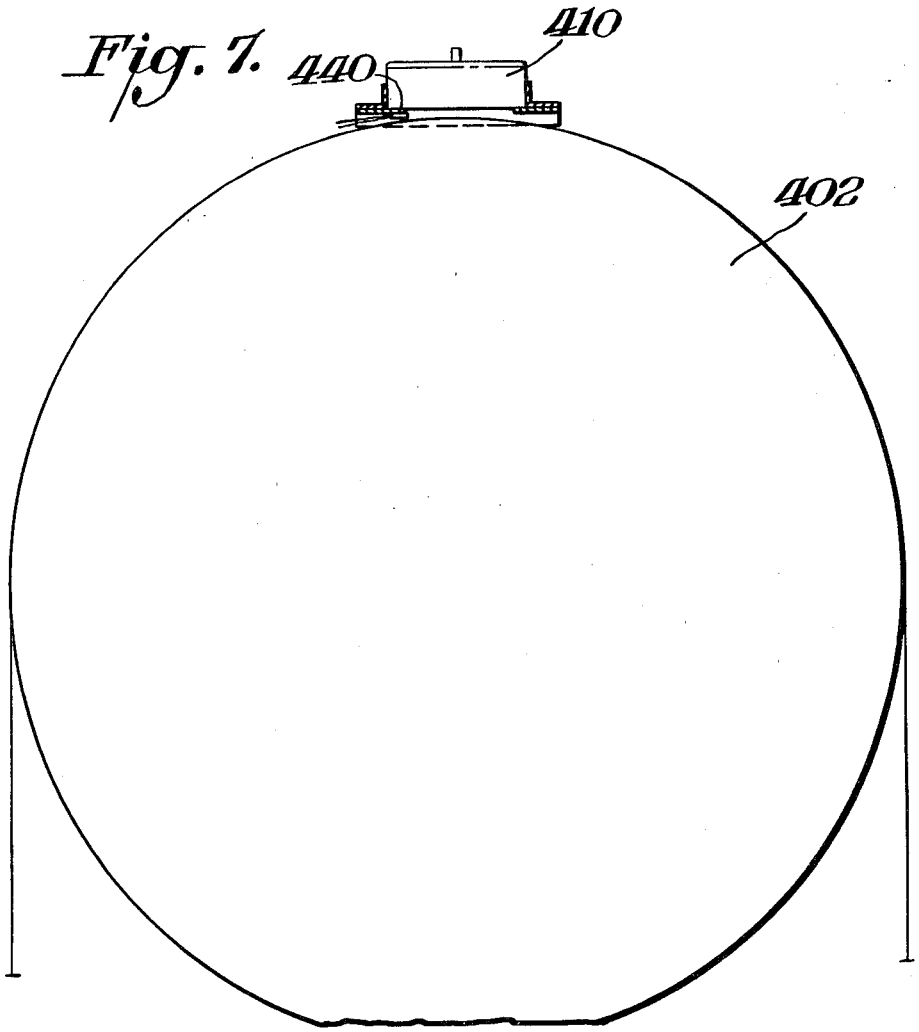
FIG. 7 is a vertical sectional view of another irradiating arrangement according to the present invention.

FIG. 7 shows a burner 410 according to the present invention placed opposite the curved face of a relatively large sized drying roll 402. Such a drying roll having a diameter of about 5 feet presents a curved outer surface which over a span of an 11 inch radiant burner face varies only about a half inch in its distance from that face. Such variation is of no real significance, even when the radiant face is positioned as close as 2 inches to the nearest portion of the roll surface. Indeed advantage can be taken of the roll's curvature by fitting a pilot light fixture 440 so that it is located in a position at which the roll surface is further away from the radiant face. Pilot flames can thus be kept a little further removed from the web being irradiated so that the risk of inadvertent scorching by the flame is reduced. This combination can also be used with the drying roll as small as about 3 feet in diameter.

Moreover the drying roll need not have the usual internal steam supply, so that it merely operates as a supporting or back-up roll that guides the web being irradiated around the cylindrical path illustrated. Alternatively steam can be supplied to the roll interior at a pressure below standard, as for instance when the roll has begun to deteriorate and will not safely hold the pressures for which it was designed.

It is also practical to build a matrix-type burner with its matrix bowed so as to follow the curvature of a roll opposite which it is mounted. Bowing of a matrix is easily done by manufacturing it in a curved mold, or where the bowing is relatively slight by merely bending it to fit into an appropriately shaped burner face. Where re-radiators are used they can be more readily bowed, or they can be fitted at an angle to the incandescent surface so as to follow the curvature of roll 402. A scoop as in FIG. 1 can be fitted to the leading edge of generator 310 or 410, or positioned to engage the web on the drying roll from which it approaches the generator.

Figure 8:
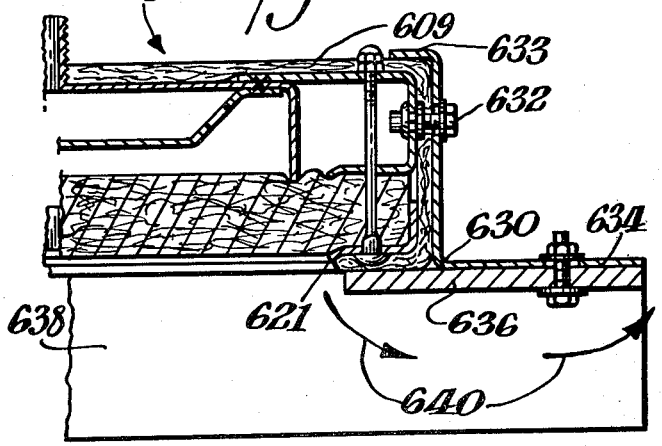
FIG. 8 is a sectional detail view of yet another irradiating arrangement pursuant to the present invention.
Figure 9:
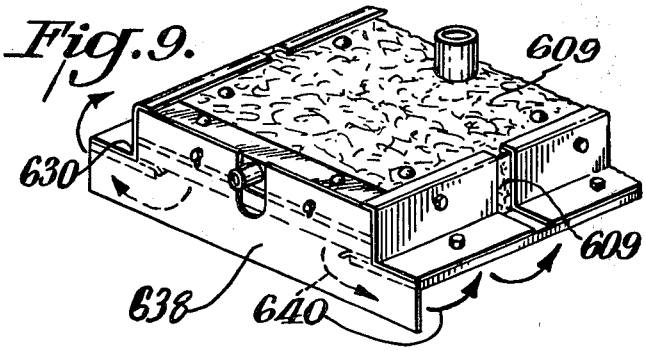
FIG. 9 is an isometric view of the arrangement of FIG. 8.

The construction of generator 410 is more fully illustrated in burner 600 of FIGS. 8 and 9, and is similar to the burners of FIG. 4 but is provided with thermal insulation blanketing 609. The blanketing extends transversely across from hold-down flanges 621 along one long side of the burner over the burner back and over to opposing hold-down flanges. The ends of the blanketing are shown as held in position by a series of metal wings 630 fastened to the burner body as by bolts or screws 632 threadedly engaged in threaded sockets fitted into the outer air seal walls as described in Ser. No. 94,901.

Wings 630 are also shown as having outwardly extended arms 634 to which a sheet of additional thermal insulation 636, preferably molded into a self-sustaining block, can be mounted to face the work being irradiated by the incandescent face of the matrix. The block or blocks 636 can thus be similar to the matrix, but they do not have to withstand the same high temperatures. In use hot combustion gases generated at the incandescent matrix face flow out over the blocks 636 and heat the outer faces of the blocks hot enough to cause those faces to materially add to the irradiation from the matrix. A block width of at least about 1 inch is needed to this end, and blocks as much as 6 inches wide are particularly effective.

Wings 630 can also have flanges 633 that engage the back of the burner or the insulation covering that back.

The blanketing 609 in FIG. 9 is shown as extending the entire length of the burner, but not over the flanges 621 of the hold-down angles at the burner ends. Instead those ends are covered by deflector panels 638 of sheet metal or thermal insulation, for example, that project down below the insulation blocks 636 and keep the hot combustion gases from escaping over those ends. As indicated by the arrows 640 those gases are thus guided over the insulation blocks 636 to cause those blocks to improve their heating effects.

If desired, panel 638 can have tabs struck out from their flat bodies to project over hold-down flanges 621 at the burner ends and hold thermal blanket sections over those flanges. Elongated burners are generally used to irradiate work that is passed transversely to their length and that does not extend beyond the ends of the burner. In such an arrangement there is not much to be gained by mounting wings 630 along those ends.

Blanket 609 can have its free ends folded back and clamped between the matrix and the hold-down angles 621. Also the blanket portion covering the back of the burner can be replaced by molded insulation blocks.

Figure 10:
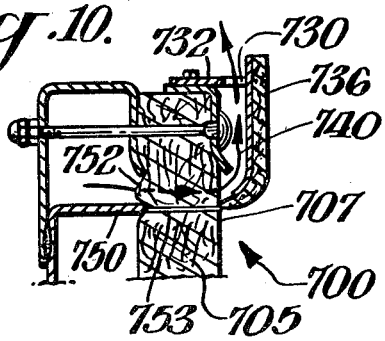
FIGS. 10, 11, 12, 13 and 14, are somewhat schematic side views of still other irradiating arrangements of the present invention.

FIG. 10 shows a modified form 700 of the burner construction of FIG. 8. Here the relatively cold air-seal gases discharged through the burner's matrix face are deflected away as shown by arrows 740, so that they do not significantly detract from the heating of a thermal block 736 mounted over the burner's edge. Block 736 is held, as by cementing, to a metal support 730 that has tongues struck out to form mounting lugs 732 by which the support is secured to the hold-down angle or to the burner side.

Block 736 is preferably arranged so that its inboard end touches the face 707 of matrix 705 at a location at which combustion mixture does not emerge from that face. That location is generally directed opposite the edges 750 that defines the inboard boundary of the air seal slot 752, but to make more certain of the location the matrix can be provided with an impervious internal stratum 753 that provides a barrier against spreading of the combustion mixture beyond the proper location. This barrier 753 can be a silicone rubber or other plastic layer provided the same way as the joint 53 in the construction of Ser. No. 863,251 with or without the help of a metal foil barrier layer.

The burner of FIG. 10 is shown as operating with its matrix held in the vertical position, but is also very well suited for operating face down. Similarly the burner of FIG. 8 can also be operated facing laterally like the burner of FIG. 10.

The burners of the present invention are particularly suited for heating materials such as wet textile webs to dry them, or latex-coated carpet backs to dry and cure the latex, or paper or paperboard webs to dry them and/or cure coatings applied to them. Thus a single burner having the construction of FIG. 8 will dry and cure a 1/16 inch thick latex layer on a carpet back moving under the burner at the rate that gives the latex a five-second exposure with the burner face held at about 1400° F. 5 inches away. For drying wet textile fabrics such as used in clothing, the burners of the present invention can be used in a pre-drier to subject freshly dyed wet fabric to about 4 to 10 seconds of irradiation from matrix faces held at about 1450° F. This sets the dye and partially dries the web fabric, the remainder of the drying being effected in any desired way, as for example by the standard steam-heated rollers or by burners having a matrix face temperature of about 1100° F.

It is generally desirable to have the burners located below the work being irradiated inasmuch as the burner body is then not subjected to so much heating and the rising hot combustion products remain longer in contact with the work, thus increasing the heating effect. In some cases however the only practical installation has the burner firing face down over the work and in such an arrangement advantage can be taken of the added downward heating effect of a trapped column of hot gaseous combustion products.

Figure 11:
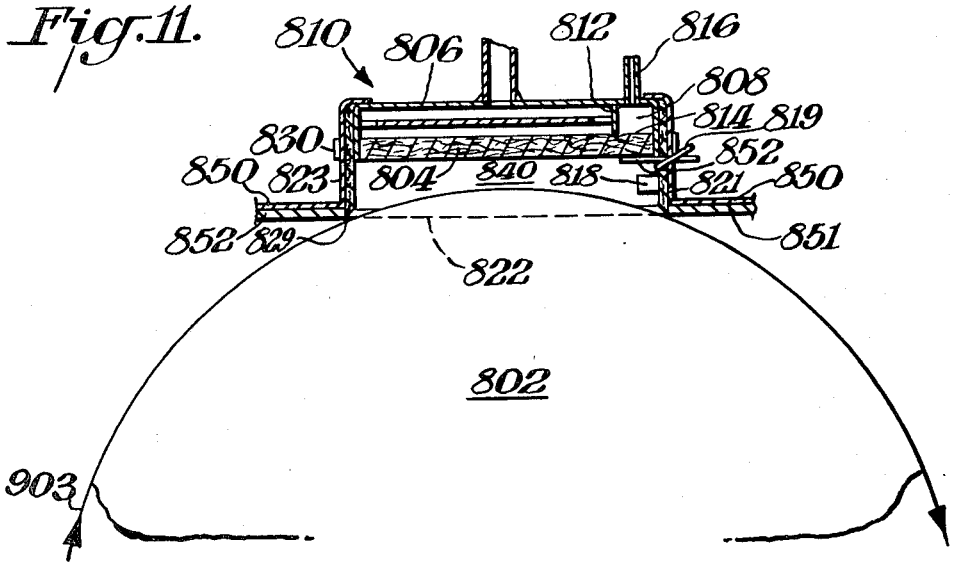

FIG. 11 shows an installation with such added downward heating effect. Burner 810 is mounted over a dryer roll 802, as in the construction of FIG. 7 but only about 3 feet in diameter, and around the roll a paper web 803 is carried past the downwardly-facing burner matrix 804. This matrix is shown as cemented in the mouth of an open-bottomed burner box 806, as in the construction of FIG. 5, and does not have an air seal. However it does have a small pilot light compartment defined by an internal partition 812 in the burner box. The pilot light compartment has a mouth 814 only about one to two square inches in cross-section, fed by a separate combustion mixture inlet 816. The combustion of the pilot combustion mixture at the outer face of matrix 804 can be used, along with the principal combustion over the balance of the matrix, for irradiating the paper 803, but because of the diminutive area of the pilot combustion its irradiation can be blocked as by a flame detector such as an ultraviolet sensor 818. Such blocking makes it impossible for the pilot irradiation to overheat the paper in the event the paper movement stops without interrupting the pilot flame. The principal combustion is stopped when the paper movement stops. A jet of cold air can be supplied as from nozzle 819 to help keep the flame detector from overheating.

It is also helpful, when the paper stops and the principal combustion also stops, to automatically turn down the pilot combustion to the minimum. This reduces the overall heat output and gas consumption during such stoppage, but is not really needed unless barrier 818 is omitted. Pilot compartment partition 812 can alternatively be omitted along with the pilot combustion mixture supply and barrier 818, so that the electrical ignition directly ignites the main combustion mixture.

Barrier 818 is shown as carried by a ceramic fiber board 821, which with three other such boards, two of which are shown at 822 and 823, are clamped around the side walls of the burner box, as by a strap 830. Board 821 can have a slot into which barrier block 818 is fitted.

A set of ignition electrodes 832 can also be carried by board 821 and held against the outer face of the pilot light portion of the matrix, to electrically ignite the pilot combustion mixture. The ignition electrodes can also include a combustion-proving electrode as in FIG. 8 of U.S. Pat. No. 4,157,155, but if desired combustion can be verified as by an ultra-violet detector that looks up at the edge of the incandescent matrix surface where it extends beyond an end of the dryer roll.

Boards 821 etc. form a compartment 840 about two inches high, and in the compartment the hot gaseous products of combustion build up until they spill out and up over the lower edges of the boards. Such build-up increases the heating effect on the paper 803. Even a one-inch high compartment gives a measurable improvement, but compartment heights greater than about 3 inches are not preferred.

Boards 821 and 823 are shown as not extending downwardly as far as the remaining compartment-forming boards, and as fitted with wings also of thermal insulation. The wings are carried by supports 850 that are clamped to the burner, and have the same function as wings 636 in the construction of FIG. 8.

When used without the wings, the compartment-forming boards can be impervious to gas, or they can be quite pervious, as the matrix is, or they can have any other degree of perviousness so long as the hot combustion gases leak through the boards at a rate lower than the rate these gases are delivered to the compartment through the matrix 804.

While the boards 821 etc. are shown as vertically positioned, they can be flared out in the downward direction, or they can be partly vertical and partly flared. The flared configuration need not have added wings, inasmuch as the flare gives about the same effect as the wings and can extend as far.

The leading edge 829 of board 923, can be positioned very close to the paper web 803, so as to act like a scoop. It is preferred that there be sufficient spacing, at least about 10 mils, between the two to assure that the moving paper does not wear away that edge. If desired burner 810 can be of the air-seal type instead of the non-air-seal type.

Figure 12:
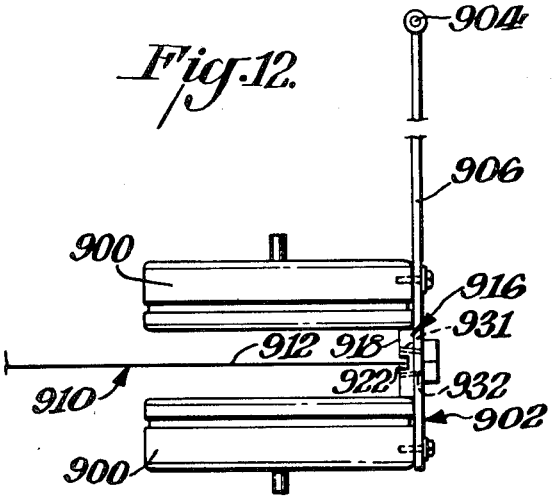

The construction of FIG. 12 is used to help dry one or both edges of a paper web. When paper dryers are fed with undryed paper wider than preferred, the outermost few inches of the edges 912 of the paper generally do not dry sufficiently. According to the present invention narrow burners 900 are placed over and/or under one or both edges 912 to more easily equalize the drying in such an installation.

In FIG. 12 two burners 900 are shown as held on an outer carry plate 902 that is pivoted from overhead pin 904 by means of an elongated beam 906, so that the burners can be pivotally retracted from the illustrated position, to simplify the threading of the paper web 910 through the drier. The burners are easily restored to their illustrative operative position where they are latched in place.

The fuel supply conduits to the burners 900 are made flexible to yield with the foregoing pivotal action or the conduits can be provided with swivel joints, the swivel axes of which are aligned with pin 904, so that the portions of the conduits secured to the burners can pivot with the burners. Where the burners have air-seal margins as in FIG. 8, a blower can be mounted on one of the burners 900 or on carry plate 902 or beam 906, to supply a stream of air for the air-seals, and if desired all the air for the combustion mixtures as well.

Carry plate 902 is also shown as holding a pad 916 of thermal insulation such as one made of felted ceramic fibers. This pad is not needed, but if used improves the drying efficiency by acting as an absorber and re-radiator of infra-red rays. It absorbs infra-red radiation emanating from the faces of burners 900 and its surface 918 becomes quite hot in doing so. This hot surface re-radiates infra-red energy to the surfaces of paper edge 912 without losing much heat by conduction to the relatively cool carry plate 902. Pad 916 can be grooved as shown at 922 to permit the paper edge to completely block direct radiation from one burner face to the other.

Passageways 931, 932 can be provided through the carry plate 902 and through the pad 916, so that the faces of the burners can be observed and thus monitored to assure proper operation. Automatic monitoring can be arranged by fitting a light or ultraviolet sensor to the passageways, and connecting them to automatically shut off all fuel flow to a burner whenever the burner face is not lit. For lighting the burners electric ignition such as shown in U.S. Pat. No. 4,157,155 can be used, or if desired pilot flames, with manual controls to override the sensors.

Grooves 922 can be flared to better permit radiation to reach the extreme margin of the paper. Burners 900 can also be equipped with scoops and/or extensive re-radiator panels as in FIG. 3 and/or confining boards such as 822 and 823.

Where two burners 900 are used at one edge of the paper, they can be located face-to-face, or they can be offset so that they do not radiate directly at each other in the event the paper web 910 tears or its edge 912 is damaged or missing. Such direct counter-radiation can rapidly damage the burner faces, particularly if those faces are ceramic fiber mats, and to guard against such damage a photoelectric web edge detector can be located upstream from the burners and connected to shut off the flow of fuel to one or both burners when the edge 912 is missing from the paper web.

A similar safeguard can be used to extinguish both burners when the paper web 910 stops or slows down excessively. Even relatively low-temperature operation of the burners can rapidly scorch a stopped paper web.

Either or both burners 900 can be equipped with re-radiator panels as in the construction of FIG. 3 for example. Where so equipped the assembly of one burner with its re-radiators can be placed directly opposite a similar second assembly but with each burner directly facing the re-radiator panel portion of the opposing assembly.

Figure 13:
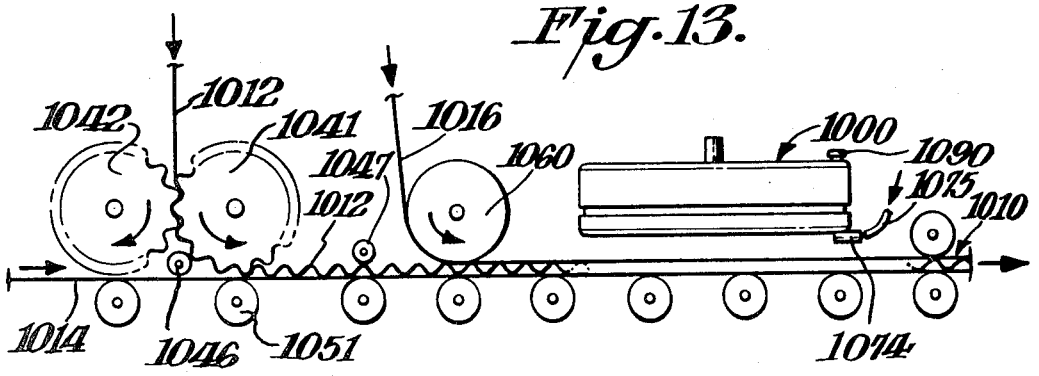

FIG. 13 illustrates the manufacture of corrugated board 1010 from a corrugated core sheet 1012, a lower face sheet 1014, and an upper face sheet 1016. Corrugating rollers 1041, 1042 corrugate the core sheet 1012 where these rollers mesh, and roller 1041 carries the corrugated sheet past an applicator roll 1046 that applies adhesive to the lower edge of each corrugation. Roller 1041 also presses the thus coated core sheet against the lower face sheet 1014 which is supported by a backing roller 1051.

Face sheet 1014 with the corrugated core sheet adhered to it moves to the right as shown in this figure, carrying the top of the core sheet past a second applicator roll 1047 which applies adhesive to the top edge of each corrugation. This assembly then is covered by the top face sheet 1016 introduced against the adhesive-coated corrugation after the lower face sheet is pressed at roller 1051, so that the adhesion of the top sheet is best reinforced by the application of heat.

To this end a burner 1000 is shown as held above the face sheet just down-stream of roller 1060, firing downwardly onto the face sheet. Only a few seconds exposure to such heating will set the top face adhesive. Heating can similarly be provided for the lower face sheet if desired. Also the freshly assembled sheets can be gripped by continuous conveyor belts pressing against one or both face sheets to more securely keep the sheets pressed as they advance to the heater and are withdrawn from it.

Burner 1000 is shown as provided with an electrically lit gas pilot light more fully illustrated in Ser. No. 94,901, but it can also be equipped with re-radiation and/or confining boards as in FIG. 11. It is also helpful to have an additional burner heating the lower face of the assembled corrugated board, as well as further burners preheating the lower face of sheet 1016 as well as the upper face of sheet 1014 just before these sheets the feed positions shown in FIG. 13.

The infra-red energy radiated by ceramic mat burners has a very high power density. It can for example cure a polymerizable silicone coating with as little as 5 seconds of radiation. It is also very effective for drying wet webs of paper or the like without the help of any steam-heated rolls.

Figure 14:
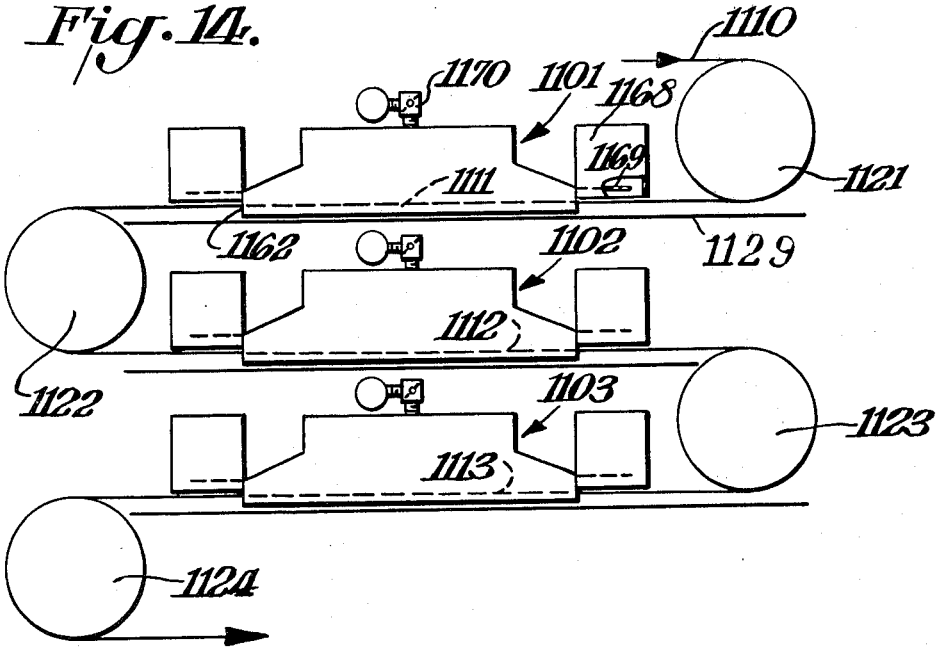

The apparatus of FIG. 14 has a series of rows of downwardly-facing burners, three rows of which are shown at 1101, 1102 and 1103. A web of wet paper 1110 makes a series of passes at 1111, 1112 and 1113 below the faces of the burners, with the help of reversing rolls 1121, 1122, 1123 and 1124. The paper can then be wound up, or if further drying is needed can be exposed to additional burners or looped over steam cans or other drying equipment. If desired all or some of the reversing rolls 1121, 1124 can be internally heated as by steam or other fluid, to make the drying apparatus more compact.

Figure 15:
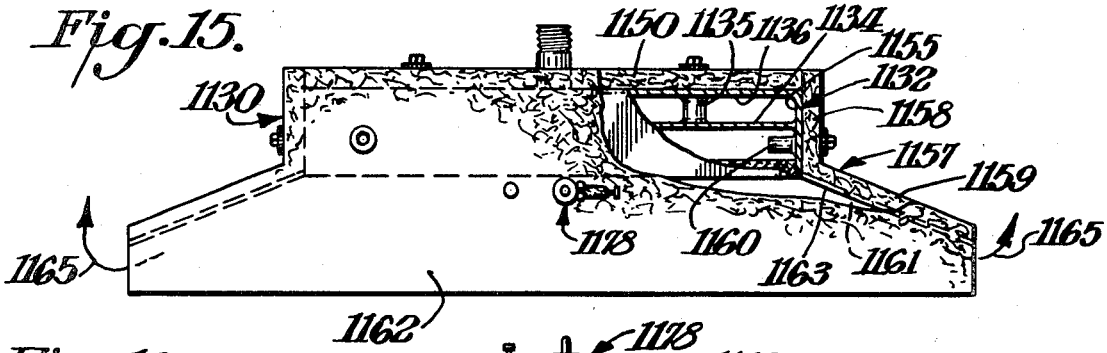
FIG. 15 is a partly broken away detail view of a burner of the construction of FIG. 14.

Each row of burners has a set of relatively small side-by-side individual burners 1130 similar to the burner of FIG. 5. As shown in FIG. 15, each burner 1130 has a generally rectangular metal body 1132 of metal like aluminum that conducts heat very well, and with a wall thickness of about ⅛ inch so that it is thick enough to effectively conduct away excessive heat. In FIG. 15 the burner has a combustion mixture deflector plate 1134 suppored by posts 1135 secured to the plate and to the back wall 1136 of the burner body. The burner body, plate, and posts are preferably brazed together, as by the molten flux dip brazing technique referred to in Ser. No. 94,901.

A single insulation block or pad can cover the backs of an entire row of burners, if desired, or can cover a single back or any other number of adjacent backs.

Figure 16:
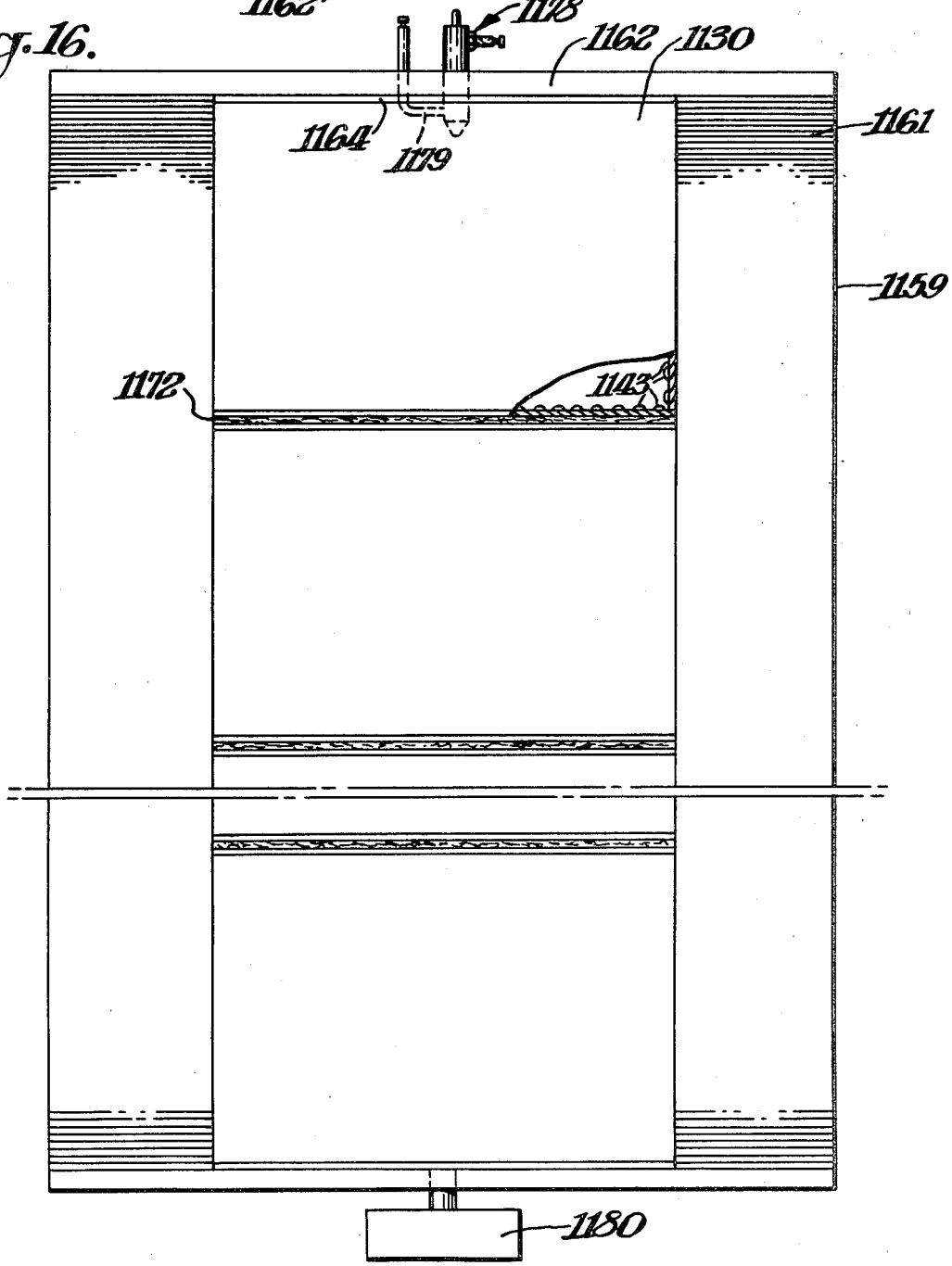
FIG. 16 is a bottom view of a burner assembly in the construction of FIG. 14.

The burner sides 1155 that are aligned to make the leading and trailing burner edges across which the paper 1110 moves, are shown in FIGS. 15 and 16 as fitted with insulation blocks 1157 that are molded into angularly related flanges 1158 and 1159. Flanges 1158 are clamped against sides 1155 with the help of posts 1160 similar to posts 1135 that are only secured to the burner side walls. Insulation flanges 1159 flare outwardly from the burner faces, preferably at an angle of about 60 to 80 degrees from the vertical. The lower face 1163 of these flaring flanges can have its surface area effectively increased as by a succession of adjacent grooves 1161. The width of flanges 1159 is preferably from about ⅓ to about ½ the width of the burners, in order to take full advantage of the heating effects of the hot combustion gases discharging from the burner faces when the burners are operating.

As shown in FIGS. 14, 15 and 16, the hot combustion gases are kept by thermal deflectors 1162 from escaping over the free edges of the burner walls 1164 at the ends of each row. Deflectors 1162 can be mounted to walls 1164 the same way blocks 1157 are mounted, but the deflectors preferably extend downwardly lower than the bottom edges of blocks 1157, to a level below the path of the paper 1110. The hot combustion gases rise and will accordingly flow upwardly around the bottom edges of blocks 1157, as shown by arrows 1165.

FIG. 14 also shows exhaust ducts 1168 that collect the hot combustion gases which can then be used as a heat source for other operations or to pass through rolls 1121–1124 to heat them. Ducts 1168 can be provided with baffles 1169 that direct the hot gases over a few more inches of the paper 1110 brfore those gases are withdrawn.

Each individual burner of a row can have its own feed trimming valve 1170 that can be adjusted to offset uneven heating effects that may be caused by differences in the porosities of the matrix faces of adjacent burners. The burners in each row can be mounted with their adjacent sides in direct contact, as in FIG. 5, but preferably a compressible pad 1172 of thermally resistant material such as ceramic fibers is fitted between adjacent burners in FIG. 16. Such a pad about ⅜ inch thick compressed to half that thickness does not make too much of a gap in the incandescent surface defined by the burner faces, and it also helps to keep the burner-to-burner joints plugged against the leakage of hot combustion gases as a result of thermal expansion during operation.

The gaps between individual burners of a row can have their radiation interrupting effects reduced by shaping the burners so that these gaps extend at an angle with respect to the direction of paper movement. This will spread the radiation interrupting effect over wider portions of the paper, or even over the entire width of the paper.

The radiation interruption at the gaps is also reduced by a tapered thickness reduction at the free edges of the burner side walls, as shown in FIG. 25 of Ser. No. 94,901. The burner matrixes 1176 are sufficiently resilient that they can be squeezed into place against such tapered walls and thus effectively reduce the width of the outer lip of the wall to about 1/16 inch even though the balance of the wall is about ⅛ inch thick.

As pointed out above, the movement of the hot combustion gases over the flared surfaces 1160 heats up those surfaces to temperatures that come close to the temperature of the incandescent burner faces, particularly when those surfaces are of low density thermal insulation. The resulting high temperature of surfaces 1163 will accordingly generate additional infra-red radiation that helps dry the paper 1110. This additional drying is provided without increasing the amount of fuel used, so that the fuel efficiency is greatly improved.

FIGS. 15 and 16 further show the provision of a burner igniter in the form of a spark-fired pilot flame director 1178 as in FIG. 13. This can be provided with its own flame-detecting rod 1179, or if desired an ultraviolet detector 1180 can be fitted at the opposite end of a row of burners, to detect burner operation when the burners are being lit, and automatically shut down the gas feed if the burners do not ignite or if they should be inadvertently extinguished.

Figure 17:
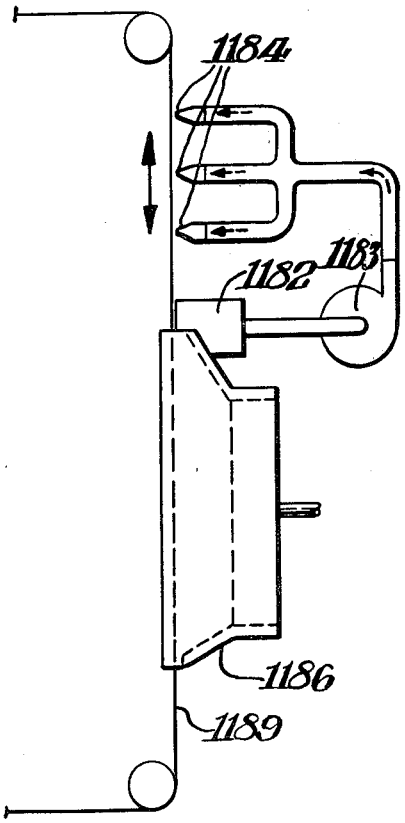
FIGS. 17 and 18 are partly schematic side views of additional irradiating arrangements typical of the present invention.

FIG. 17 illustrates a modified arrangement used to heat paper or other webs that are moving vertically rather than horizontally. In such an orientation the hot combustion gases need not flow downwardly out of the bottom edges 1186 of the burner units, so that those edges can be relatively short lengths of insulation that are horizontal or only mildly flared—about 20 to 30 degrees down from the horizontal. Those lower edges can also be brought relatively close to the moving web 1189—about ½ inch—to limit the ingress of ambient relatively cool air into the hot combustion gases.

To improve the heating effect of the hot combustion gases they are withdrawn through a top exhaust duct 1182 and propelled by a blower 1183 to jets 1184 from which those hot gases are jetted against the moving web 1189. This breaks up the boundary layer barrier of steam or the like that can be present on the web.

The burners of the present invention dry paper with particular effectiveness. The radiation they emit is about as efficient in removing the last bit of excess water from an almost bone-dry paper, as it is in removing the first bit of water from a very moist sheet, and this permits an unexpectedly sharp drop in the bulk of a paper dryer.

However textile webs of cotton, wool, polyester, rayon, polypropylene, dacron and the like, or mixtures of such fibers, as well as plastic films are also very efficiently dried or cured with such burners.

A guide, such as plate 1129 in FIG. 14, can be used to assist with the threading of web 1110 past the burners in preparation for a drying run.

The grooving 1161 preferably has a depth of at least about ⅛ inch, and this depth can be as much ½ inch. The grooving effectively increases the surface 1161 as compared to a perfectly flat surface, and an increase of at least about 50% is desired. To this end the profile of the grooves can be triangular, rectangular, sinusoidal, or have any other shape.

The combustion gases discharging from the far ends of the surface 1161 can still be sufficiently hot to warrant their use as for heating a further radiating surface. Thus those gases can be sucked through a porous insulator such as a ceramic fiber matrix positioned as an outer extension of surfaces 1161. The resulting relatively forceful flow of still hot gas through the porous matrix heats it up more effectively than the surface 1161 is heated, so that the heated face of the porous ceramic fiber matrix can contribute a significant amount of additional infrared radiation.

The use of the surfaces such as 1161, with or without the foregoing extensions improves the operation of any fuel-fired burner that generates hot combustion gases. Thus burners 1130 can be replaced by ceramic tile burners, metal screen burners, or ceramic cup type burners, or even direct flame burners, and in each case the burner operation shows a similar improvement.

Figure 18:
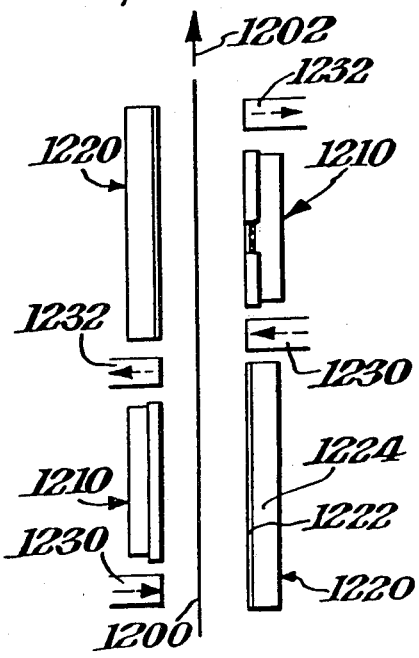

FIG. 18 shows a particularly effective heating arrangement for heat treatment of a moving web 1200, such as textile drying and curing or paper processing, the direction of movement being shown by arrow 1202. In this arrangement a series of burners 1210 face the moving web adjacent each other on opposite sides of the web. Immediately facing each burner 1210 is a re-radiator 1220 having a very thin layer of heat-absorbing material such as oxidized stainless steel 1222, backed by a high temperature insulator 1224 such as refractory felt. The re-radiators are preferably substantially wider than the burners and in use the heat absorbing layer 1222 absorbs substantial quantities of heat which penetrate through web 1200 so that the layer becomes quite hot and re-radiates heat back to the web 1200. To improve the drying or gas-removing effect of the heat treatment process intake and exhaust ducts 1230 and 1232, respectively introduce streams of poorly saturated air adjacent the location where the web approaches the burner, and withdraw more saturated air adjacent the locations where the web leaves the burner. To further improve the efficiency of this system, heat from the withdrawn air can be used to preheat the incoming poorly saturated air.

The re-radiation of energy from re-radiators 1220 is improved by giving those re-radiators a dark or even black surface and by reducing the thermal conductivity from that surface to the structure that holds the surface in place. Thus the surface can be a layer of black pigment such as silicon carbide sintered to the surface of a ceramic sheet such as a sheet of felted ceramic fiber. The sintering method described in U.S. Pat. No. 4,110,386 can be used for example.

Such a dark-faced fibrous sheet need not be very thick, and a thickness of ¼ inch or even less can be used so long as such a sheet is held in position. The re-radiator as well as the incandescent matrix face can also be coated with emissivity-improving materials such as finely divided platinum black or even $Cr_2O_3$. These materials can be deposited from platinum chloride and chromium nitrate solutions, respectively, sprayed on the surface being coated, after which the surfaces are fired.

A dark surface is a very good absorber and re-radiator of infra-red energy, and is not much affected in the event it becomes soiled or dusty. In general the energy that most readily penetrates the web being irradiated, is the higher frequency energy, and such energy is absorbed and re-radiated at a lower frequency which is more effective for drying.

Where the arrangement of FIG. 18 is used to heat webs that are not wet, the air ducts can be eliminated and the re-radiators can then occupy essentially the entire space on each side of the web, to the extent such space is not occupied by the burners. More than one burner can be used on each side of the web, with the re-radiators filling all remaining spaces.

The FIG. 18 construction is particularly suitable for use with webs that are of open weave, such as screening. Thus metal wire screening is very inexpensively coated with cured epoxy resin as by first electrostatically applying epoxy powder, or spraying it with molten resin, and then passing the resin-carrying web through the burner-re-radiator assembly. The modified assembly without air ducts and with the maximum amount of re-radiating surface is best for such treatment.

Inasmuch as both the incandescent burner faces and the re-radiating surfaces should be as close as practical to the web if the greatest irradiation effectiveness is to be obtained, these faces and surfaces on each side of the web are conveniently arranged to lie in approximately the same plane. Such an arrangement is very simple to construct inasmuch as the re-radiators can simply be fitted against or between the burner side walls, for example.

Infra-red radiation is also highly effective for preheating plastic sheets to prepare them for pressure or suction forming. Thus a continuous sheet of polystyrene or the like can be moved in steps toward a cutting and molding press that stamps out successive suitably dimensioned portions and successively molds them into shape, with the sheet subjected to any of the irradiation arrangements described above immediately before it reaches the cutting and molding press. By making the irradiation zone equal in sheet travel length to the length of each sheet advancing step, uniform pre-heating of the sheet is obtained.

Where it is necessary to limit the amount of pre-heating so that an incandescent radiator surface must be substantially smaller than the length of an advancing step, the advancing sheet can be arranged to first advance at an uninterrupted uniform rate past a short irradiation zone, and to then be carried as by a tenter frame assembly that permits stepwise feeding to the cutting and molding press.

In the event the preheating tends to cause the plastic sheet to shrink in width or length, the heated sheet can be placed under tension, transversely or longitudinally or both. To this end a tenter frame type step advancing means can be provided with weighting rolls to apply longitudinal tension to loops of the sheet, and can additionally or alternatively be fitted with clamps that grip the side edges of the sheet and in this way apply transverse tension.

Burning a gaseous hydrocarbon fuel at the surface of a ceramic fiber matrix has been found to yield exceptionally small amounts of carbon monoxide and nitrogen oxides. Burners of this type are accordingly highly suited for industrial and domestic space heating by merely facing the incandescent matrix toward the space and the people to be warmed. The gaseous combustion products leaving the matrix can thus be permitted to enter and diffuse through the space being warmed, without increasing the carbon monoxide and nitrogen oxide content of the air in the space as much as it would be increased by open flames of conventional fuel-fired heaters or even cooking ranges. A matrix type space heater is accordingly very inexpensively installed. Since it is also a very effective generator of infra-red energy and warms both through such infra-red generation as well as by the heating effects of its hot combustion products, it also makes a highly efficient installation.

Figure 19:
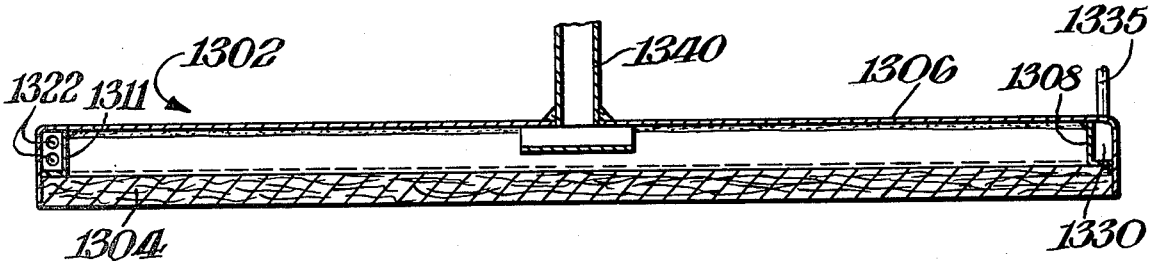
FIGS. 19 and 20 are respectively a vertical section and a face view from below, of a modified burner according to the present invention.
Figure 20:
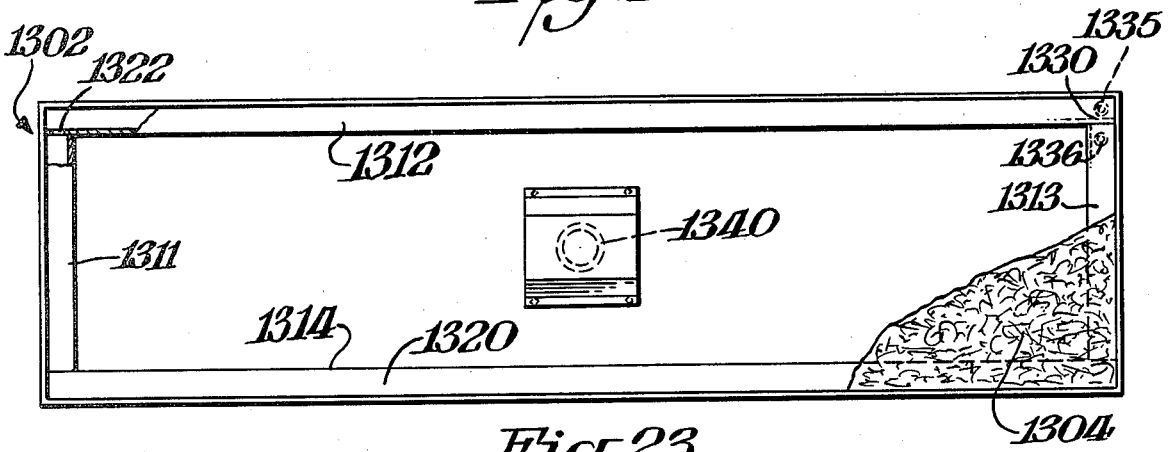

If desired such a space heater can be equipped with a hood that collects its combustion products as they rise from a laterally directed vertical matrix face, for example, and vents them through a chimney or stack. Inasmuch as matrix combustion is essentially stoichiometric there is essentially no excess air in those combustion products so that the cross-sectional area of the stack or chimney can be quite small.

Where burner bodies are to be kept as compact as possible, as for example when mounted in a confined space as in FIG. 6, a burner can have the construction shown in FIGS. 19 and 20. In this construction the burner 1302 has no air-seal, and its matrix 1304 is fitted directly in the open mouth of an open burner box 1306, as in FIG. 5. The burner box can have a gas-tight construction and be made of aluminum or stainless steel, or plain carbon steel. Before inserting the matrix, there is mounted in the burner box a set of partitions 1311, 1312, 1313 and 1314 that encircle its four walls. Each partition is shown as L-shaped in cross section with the short arm of the L positioned to form a ledge 1320 against which the matrix rests. Such a shelf need only be about ½ inch wide and makes a very desirable stop that keeps the matrix from penetrating too deeply into the box when the matrix is installed. The matrix is preferably cemented in place in the manner described in Serial No. 952,332.

Partitions 1312 and 1314 are shown as extending the full length of the interior of box 1306, while partitions 1311 and 1313 extend from partition 1312 to partition 1314. Openings 1322 are punched in the ends of partitions 1312 and 1314 so as to interconnect the chambers formed between the partitions and box wall. One partition end 1330 can remain unpunched and inlet and outlet tubes 1335, 1336 fitted in the wall of the box on opposite sides of this unpunched end, for the introduction and removal of a cooling fluid.

The partitions are installed by dip-brazing or welding, so that the coolant chambers they form are gas tight. The cooling fluid can be tap or deionized water, where the chamber walls are stainless steel or aluminum. Some boiling point depressant like ethylene glycol can be added to such water, particularly where the interiors of the coolant chambers are as narrow as ⅜ inch inasmuch as parts of the box wall can then reach a temperature above the normal boiling point of water, when the burner is in operation. Such an additive also reduces the danger of freezing when the burner is not operating and is exposed to a very cold climate.

It is also helpful to add a corrosion inhibitor such as zinc chromate to coolant water if that water comes into contact with plain steel or even aluminum.

The coolant inlet and outlet tubes are shown as emerging from the back wall of the burner box, but they can instead be fitted to a side wall, as where not enough space is available in back of the back wall. The combustion mixture inlet 1340 is also illustrated as fitted in the back wall and can likewise be moved to a side wall. Such a side wall mounting can have the combustion mixture inlet penetrate through the box side wall and through the adjacent partition, but if desired that partition can be interrupted so that it does not extend over such a side-wall installation, or that partition can be completely omitted.

The burner of FIGS. 19 and 20 can also be made by a casting technique so that all of its metal structure is formed in one operation. Its coolant chambers can also be enlarged and brought into close heat-exchange relation with the incoming gaseous combustion mixture, so that the coolant need not be supplied and withdrawn to keep it from overheating. Instead the enlarged coolant chambers can be kept disconnected from circulation conduits and have fins on their combustion-mixture-contacting surfaces for better heat-exchange with the combustion mixture. In addition such chambers can have their coolant contents exposed to the atmosphere so that it can boil a little if overheated.

Partitions 1308 can be made of simple flat sheets welded or brazed in place, instead of L-shaped members. Such flat sheets can span the corners between the back and side walls of a pre-formed burner box, and need not provide a ledge for the matrix.

Figure 21:
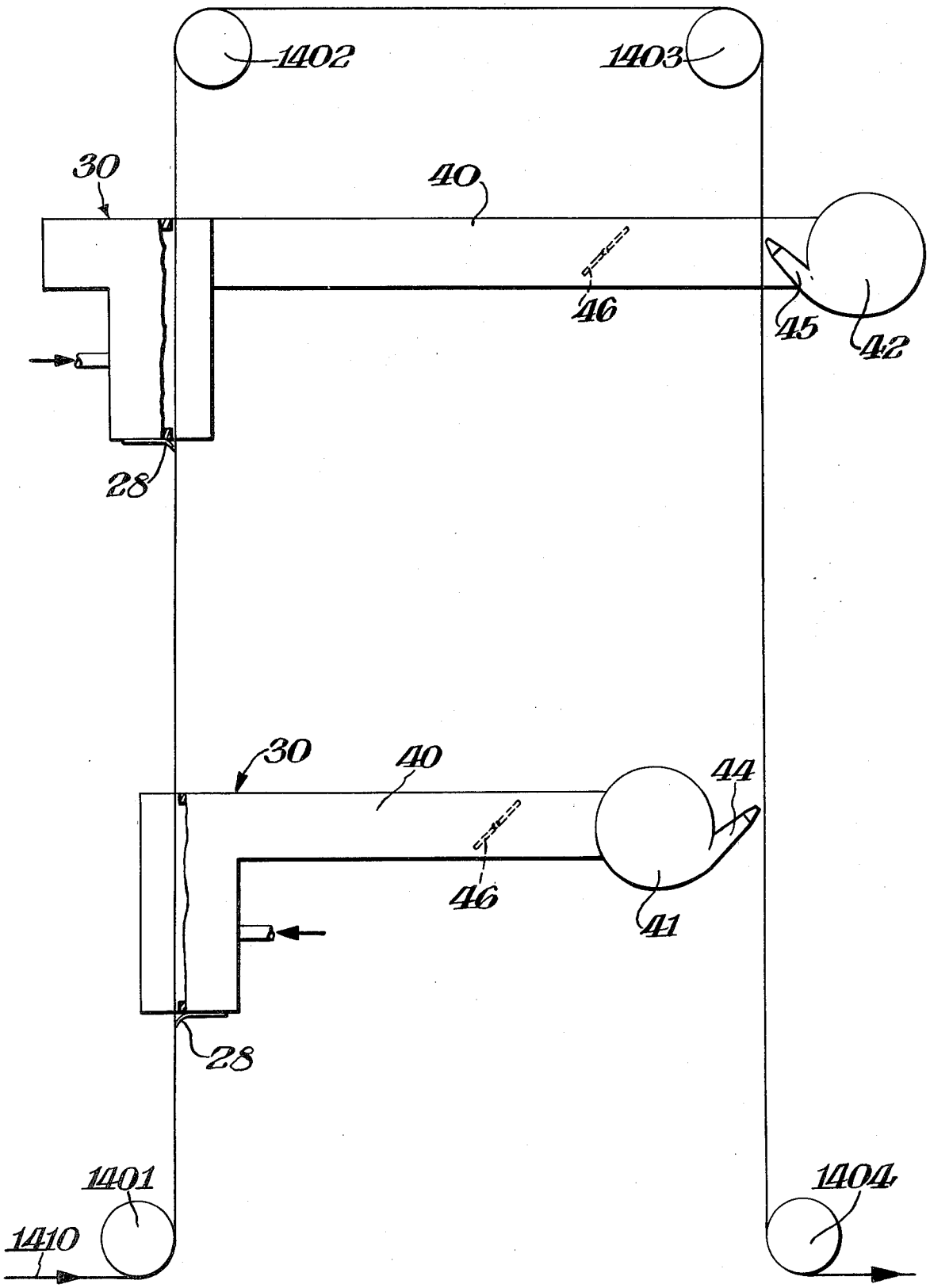
FIG. 21 is a schematic side view of yet another irradiating apparatus incorporating the present invention.

FIG. 21 illustrates a very effective pre-dryer of the present invention. This pre-dryer has four rolls 1401, 1402, 1403 and 1404 that guide a freshly dyed textile web 1410 to a set of steam-heated drying rolls (not illustrated) where the final drying is effected. Between rolls 1401 and 1402 the web moves upwardly and in this travel each of its faces is irradiated by a heater assembly 30 illustrated in FIG. 1. Each of these assemblies has a draw-off conduit 40 through which gaseous combustion products that are still quite hot, are withdrawn. These conduits 40 lead to the intakes of blowers 41, 42 which have their discharge outlets 44, 45 directed to rapidly blow the discharged gases against the textile web as it descends between rolls 1403 and 1404.

The heater assemblies 30 can each have a scoop 28 that not only improves the drying action but also helps keep the web from fluttering as it moves upwardly. Such fluttering generally takes place, sometimes to a dangerous degree, in pre-dryers that have a substantial span between rollers 1401 and 1402.

The discharges of blowers 41 and 42 are preferably arranged to propel against the textile web, streams of hot gas at a velocity of at least about 10 linear feet per second. The velocity brings the hot streams in very good heat exchange relation with the web. The heat exchange relation is also improved by inclining the hot streams about 30 to about 60 degrees upwardly. An enclosure can be provided around the downwardly moving textile web to help confine the blown streams near that web as they move upwardly alongside it.

FIG. 21 also shows an adjustment device in the form of a damper 46 in conduit 40. This damper can be opened or closed to provide the optimum drying effect. Thus the re-radiator 26 of assembly 30 will supply the best heating when it is at the highest possible temperature, and damper 46 can be adjusted while the surface temperature of the re-radiator is measured with a pyrometer. Opening the damper too wide can increase the suction in the discharge plenum 35 so much as to draw ambient air in through the re-radiator and this will cool down the re-radiator surface. On the other hand closing the damper too much reduces the volume of hot gas blown through the pump outlet. Optimum drying is generally effected when the damper is as far open as it can be set and still keep the re-radiator surface very hot.

Only one drying assembly can be used in the apparatus of FIG. 21, or conversely a large number of them can be used so that little or no steam roll drying is needed.

Figure 22:
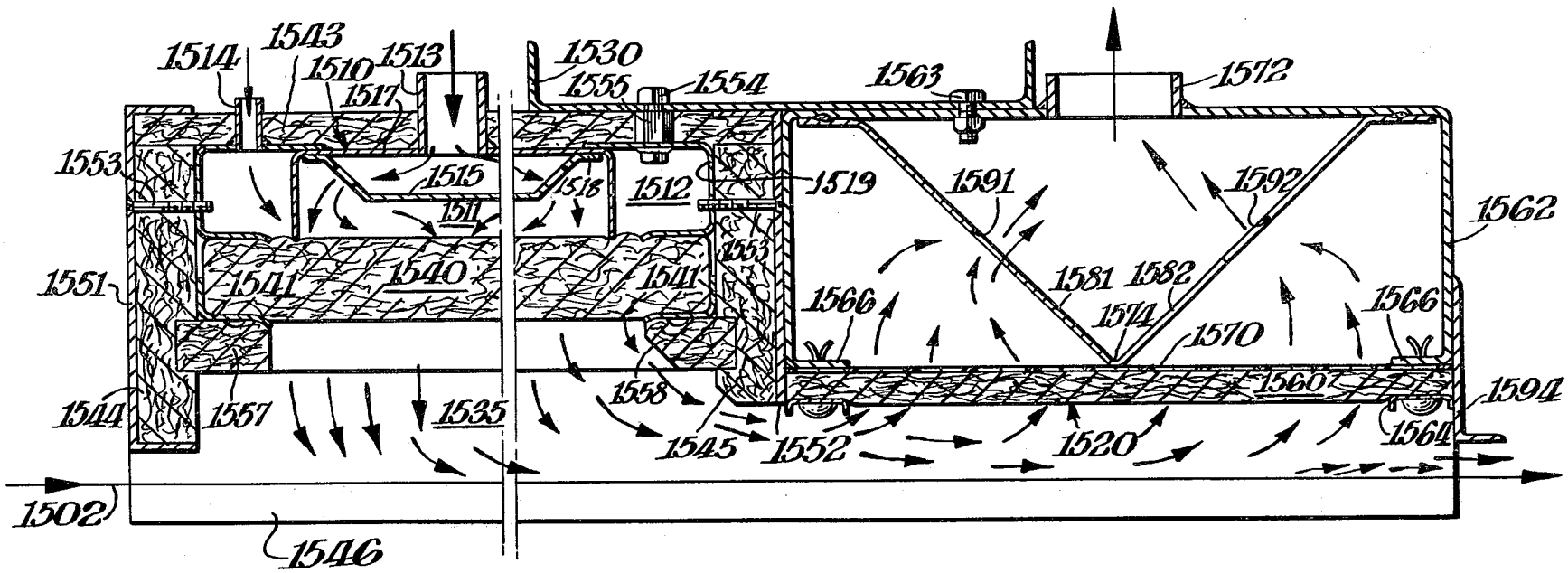

FIG. 22 shows an infra-red radiator particularly suited for irradiating downwardly onto a substrate web such as textile or paper or the like. Such a web is illustrated at 1502 as horizontally oriented and moving from left to right. Over this web is positioned a matrix-type burner 1510 and an adjacent re-radiator 1520, both supported from an overhead channel 1530.

Burner 1510 is of the air-seal type having a combustion mixture plenum 1511 surrounded by an air seal plenum 1512, each having inlet conduits 1513, 1514, respectively. The burner extends only about one foot or so in the direction of web travel, and transversely of that direction the burner extends the full width of the web. A trough-shaped diffuser 1515 also extends the full transverse length of the burner and is shown as spot-welded to the burner back 1517 at 1518. The same spot welds are used to secure the air-seal plenum channel 1519 to the burner back.

Matrix 1540 is clamped against the plenum faces in the same manner as in FIGS. 8 and 9, with the help of a set of hold-down angles 1541. A block 1543 of thermal insulation covers the top of the burner, and its sides are covered with similar depending blocks including an upstream block 1544, a downstream block 1545 and two side blocks 1546. These blocks are clamped against the air-seal channels by metal retaining angles two of which are shown at 1551 and 1552, as by bolts 1553, and the entire burner assembly secured to the under face of support channel 1530 by a set of mounting bolts 1554. Spacers 1555 around the shanks of the bolts keep the burner properly positioned.

FIG. 22 also shows the hold-down angles 1541 as having their lower faces covered by framing blocks 1557 and 1558 rabbetted into grooves cut into the downwardly extending insulation blocks and cemented in place there.

Re-radiator 1520 has a porous insulation panel 1560 fitted over the mouth of an outlet plenum box 1562 which in turn is also secured to the underside of mounting channel 1530 by a set of bolts 1563. A set of shallow channels 1564 clamp the panel in place against flange lips 1566 turned in at the mouth of box 1562. A porous stiffener such as an expanded metal grille 1570 can back up panel 1560 to keep it from bowing upwardly under the influence of suction applied through exhaust conduit 1572 to the interior of the box.

The sucking of gas through panel 1560 can be distributed as by a diffuser type angular partition 1574 having two walls 1581 and 1582 each perforated at 1591, 1592, extending from the back of panel 1560 or from its rigidifying support 1570, to the back of box 1562. Suction applied to exhaust conduit 1572 can thus be divided equally between the halves of panel 1560 on either side of the diffuser partition.

Perforations 1591 and 1592 can be equipped with slides that can be manipulated to partially or completely block the perforations, and thus unbalance the suction at the plenum halves when desired. Such unbalance can compensate for partial plugging or different porosities in portions of the panel, or can be used to increase the gas sucked through the panel in selected areas.

More diffuser partitions can be used to further vary the suction distribution, or separate slides can be fitted to the back of stiffener 1570 to similarly distribute the suction.

As illustrated in FIG. 22, the burner 1510 and the outlet plenum box 1562 are supported from a relatively narrow channel 1530. Additional support is however provided by connections made to the various conduits these members have. Further support can be provided if needed.

When the burner 1510 is in operation, the lower face of matrix 1540 becomes incandescent and causes very intense irradiation of web 1502 as it passes underneath that face. At the same time the hot gaseous combustion products accumulate in the space 1535 below the matrix, and being of lower density that the surrounding atmosphere, spill over the lower edge of block 1545 and from there under the lower face of re-radiator panel 1560. The vertical distance between the incandescent face of matrix 1540 and the lower edge of block 1545 is preferably from 1 to 2 inches, so that a significant depth of the hot gaseous combustion product is held below that incandescent face. A barrier 1594 can if desired be placed at the far end of panel 1560 to also cause the build up of the hot combustion gases below that panel. Barrier 1594 can be as much as about 1 inch in depth, but need be no deeper than required to retain whatever hot combustion gases are not sucked through panel 1560. To improve the flow of the hot combustion gases from space 1535 over toward the re-radiator panel, framing block 1558 and/or downstream block 1545 can be beveled as shown.

The accumulation of a significant depth of hot combustion products in space 1535 significantly improves the intensity of irradiation. A similar increase in irradiation intensity is effected by a corresponding gaseous build up below panel 1560. The lower face of panel 1560 is also heated by those hot combustion gases so that it in turn re-radiates infra-red energy to web 1502.

Although burner 1510 is of the air-seal type and thus delivers narrow streams of unheated air through the matrix 1540 and thence into the margins of space 1535, the additional irradiation produced by the apparatus of FIG. 22 is still substantially larger than that produced by burner 1510 alone. A further increase in irradiation effectiveness can be obtained by extending the framing blocks 1557 and 1558 so that they cover the portions of the matrix through which the air-seal air emerge, and hollowing out those framing blocks to provide outlet passages for the air-seal air to discharge from the outside margins of the blocks surrounding the burner.

Figure 23:
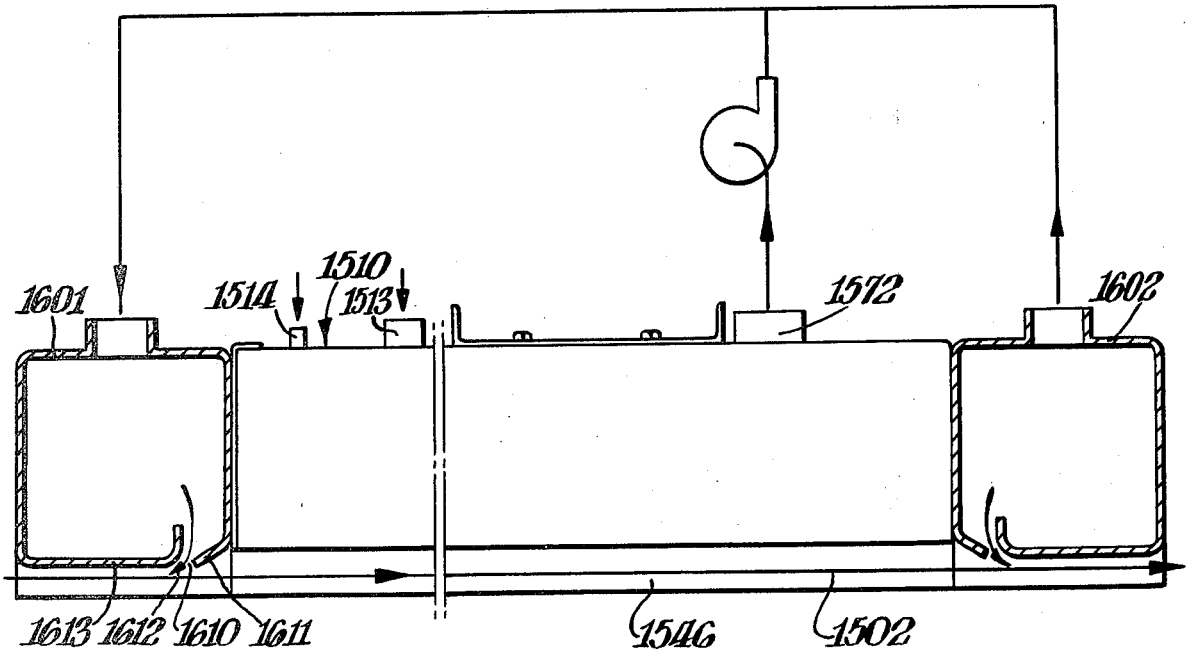
FIGS. 22 and 23 are vertical sectional views of further modified infra-red radiators of the present invention.

As shown in FIG. 23, the infra-red radiating burner 1510 can have a Bernouilli airfoil floating dryer 1601 preceding it in the path through which web 1502 moves during the drying. Dryer 1601 is an elongated box that can be generally rectangular in cross-section and provided with a very narrow slot 1610 through which a stream of heated gas such as air is expelled at a velocity of ten to fourteen thousand linear feet per minute. The slot lips 1611, 1612 are shaped to divert the expelled stream at an acute angle, about 30 to 60 degrees away from the box wall 1613 that forms upstream lip 1612. At such stream velocities the stream moves along the surface of substrate 1502 and developes Bernouilli forces that urge the substrate toward, but also hold it short a fraction of an inch from wall 1613. This type of gas flow is rather turbulent and very effectively subjects the substrate to the drying action of that stream.

The gas stream for dryer 1601 is preferably taken from the hot combustion products discharged by burner 1510, as by enclosing the combined dryer structure in a housing into which all the hot gases flow, and from which a blower blows some of those gases into the interior of the box of dryer 1601.

Dryer 1601 is shown as directing its discharged stream counter-current to the movement of the substrate but can alternatively discharge its drying stream in the opposite direction so that it moves co-current with the substrate. Moreover, two or more such Bernouilli airfoil dryers can be fitted to the leading wall of burner 1510, and these can have their gas streams all directed counter-current, or all co-current, or some one way and the remainder the other.

Another Bernouilli airfoil dryer 1602 is shown as fitted to the exit end of dryer 1510 and can operate like the preceeding dryer or dryers 1601. Also, the re-radiator panel 1560 can be eliminated along with its mounting structure, so that the exit Bernouilli airfoil dryer 1608 directly follows irradiating burner 1510. The Bernouilli airfoil drying combination does not require the build-up of any significant depth of hot gases under the burner matrix or under the re-radiation panel, if used.

Obviously many modifications and variations of the present invention are possible in the light of the above teachings. It is therefore to be understood that within the scope of the appended claims the invention may be practiced otherwise than as specifically described.

What is claimed is:

1. A heating apparatus for heat treating a web through which web infra-red radiation penetrates, said apparatus having a series of infra-red generators with generally flat infra-red-generating surfaces on alternate sides of a track along which the web is to move during the heat treatment, the generators being spaced from each other so that one generator does not directly face another, and a series of infra-red re-radiators having a thermally insulated surface that is a good absorber of the infra-red energy generated by the generators, each re-radiator being wider than and directly facing a generator so that infra-red radiation penetrating through the web from a generator on one side of the web reaches and heats a re-radiator on the other side of the web and causes the re-radiator to re-radiate infra-red radiation toward the web.

2. The combination of claim 1 in which the spaces in the irradiation zones not occupied by generators are essentially completely occupied by re-radiators.

3. A heating apparatus for heat treating a web through which web infra-red radiation penetrates, said apparatus having an infra-red generator with a generally flat infra-red-generating surface on one side of a track along which the web is to move during the heat treatment, and an infra-red re-radiator having a thermally insulated surface that is a good absorber of the infra-red energy generated by the generators, on the other side of that track, the re-radiator being wider than and facing the generator so that infra-red radiation penetrating through the web is received by the re-radiator and causes it to re-radiate infra-red radiation toward the web, the generator and the re-radiator being about equally spaced from the track.

4. The combination of claim 3 in which the re-radiator is the surface of a ceramic.

5. An apparatus for applying infra-red radiation to a moving web as it passes along a treatment zone, said apparatus having a gas-fired burner with a generally flat infra-red generating radiant face heated by combustion of the gas and facing said zone, a re-radiator member carried by an edge of the burner and having a ceramic fiber surface also facing said zone and in contact with the hot gaseous combustion products discharged by the burner, so that said ceramic fiber surface is heated by the combustion products and such heating causes it to emit additional infra-red radiation, said ceramic fiber surface having a surface area at least one-fourth the surface area of said radiant face.

6. The combination of claim 5 in which the re-radiator member is porous and a suction device is connected to suck the hot gaseous combustion products through the ceramic fiber surface.

7. The combination of claim 5 in which the radiant burner face extends generally vertically and ceramic fiber surface is located immediately above the radiant face.

8. The method of heating with an infra-red generator a web that transmits a sizeable fraction of infra-red radiation to which it is exposed, which method is characterized by: (a) operating an infra-red generator that has a radiant face which radiates infra-red energy, (b) placing the web with one of its surfaces in front of that radiant face to cause the web to become heated by the radiated infra-red energy, and (c) placing an infra-red re-radiator on the other side of the web to become heated by the portion of the radiation that passes through the web and re-radiate infra-red energy back to the web as a result of the last-mentioned heating.

9. A gas-fired burner having a burner body forming a combustion mixture plenum, a gas pervious ceramic matrix disposed over the plenum to define a burner face on which the combustion mixture is burned after it passes through the matrix, to heat that face to incandescence and thus cause it to generate infra-red radiation to heat treat a substrate, and a layer of ceramic fiber matting extending along an edge of the incandescent face to absorb heat dissipated from the burning and thus provide an auxiliary infra-red radiating face at least about an inch wide to also heat treat the substrate, the periphery of the matrix being connected to receive and pass a narrow stream of non-combusting gas that emerges from the margin of the incandescent matrix face, and the fibrous matting is spaced from that face margin and held by a support that permits the emerging non-combusting gas to be deflected away without significant engagement with the auxiliary infra-red radiating face.

10. A gas-fired burner having a metal burner body forming a combustion mixture plenum chamber, a gas-pervious ceramic fiber matrix disposed over said chamber to define a burner face on which the combustion mixture is burned after it passes from the plenum through the matrix, a metal holding frame secured to said body and having a flange overlying the outer face of said matrix around its marginal edges to hold the matrix in place, and a high-temperature thermal insulation blanket covering the outer face of the frame to insulate it against absorbing heat from the burned combustion mixture and from objects heated by the burner.

11. The burner of claim 10 in which the insulation blanket is held in place by an edge that is folded under the frame flange and clamped there by the flange.

12. The burner of claim 10 in which the burner body also provides a separate gas-supply plenum encircling the combustion mixture plenum and having a face against which the periphery of the matrix is held by the flange, and a discharge slot in that plenum face, said slot encircling the combustion mixture plenum.

13. In the process of drying an elongated wet web with a gas-fired infra-red generator having an incandescent face that generates intense infra-red irradiation, the improvement according to which that web is moved to carry one of its surfaces past that generator face at a distance between about 2 and about 4 inches from that face, and just before it reaches that face said web surface is moved past a scoop not more than 1 millimeter from that surface to cause the scoop to remove from adjacent that web surface its moist boundary gas stratum.

14. The combination of claim 13 in which the infra-red generator is not surrounded by a housing.

15. The combination of claim 13 in which the wet web is a porous web and a second scoop is provided at a location just before the web arrives at the generator face, to remove its moist boundary gas stratum from adjacent the web surface opposite the one that is subjected to infra-red radiation.

16. An apparatus for generating infra-red radiation and applying such radiation to a substrate, said apparatus having a generally flat-surfaced porous matrix through the thickness of which a gaseous combustion mixture is passed and on the generally flat surface of which it burns to heat that surface to incandescence, that surface is bounded by walls that form an open compartment about 1 to about 3 inches deep when the matrix faces downwardly, the compartment having about the same area as the above-noted matrix surface, and the mouth of the compartment being bounded along at least one edge by a wing that carries a ceramic fiber re-radiator surface closer to the substrate being treated by a distance corresponding to the depth of the compartment.

17. The combination of claim 16 in which the internal faces of the compartment walls are thermally insulating re-radiators.

18. The combination of claim 16 in which the re-radiation surface has at least one-fourth the surface area of the incandescent burner face.

19. An apparatus for applying infra-red radiation in a lateral direction to a moving web oriented so that the plane of the web is essentially vertical as it passes through a treatment zone, said apparatus having a gas-fired burner with a generally flat generally vertically oriented infra-red generating face that is heated to incandescence by the burning of the gas with which the burner is fired and is positioned about two to about four inches from said zone, no housing surrounds the treatment zone, and a ceramic fiber re-radiator surface is located immediately above the infra-red generating face and is positioned to be heated by the hot gaseous combustion products rising from the burner and to face toward the treatment zone to further irradiate the moving web, and the treatment zone is closely bounded by shielding to reduce the dilution of the hot combustion gases by ambient air.

20. The combination of claim 5 in which the ceramic fiber surface of the re-radiator is positioned closer to the treatment zone than the radiant face of the burner.

* * * * *